US007089970B2

(12) United States Patent
Bernard

(10) Patent No.: US 7,089,970 B2
(45) Date of Patent: Aug. 15, 2006

(54) RATCHET STYLE INSTALLATION TOOL

(75) Inventor: William A. Bernard, Darien, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 10/998,459

(22) Filed: Nov. 29, 2004

(65) Prior Publication Data

US 2005/0115629 A1 Jun. 2, 2005

Related U.S. Application Data

(60) Provisional application No. 60/526,222, filed on Dec. 2, 2003.

(51) Int. Cl.
*B21F 9/02* (2006.01)

(52) U.S. Cl. ..... 140/123.6; 140/93.2

(58) Field of Classification Search ..... 140/92.2, 140/92.4, 123.5, 123.6; 81/474, 475, 177.8, 81/177.9, 177
See application file for complete search history.

(56) References Cited

U.S. PATENT DOCUMENTS

| | | | | |
|---|---|---|---|---|
| 721,442 | A | 2/1903 | Herrick | |
| 870,678 | A | 11/1907 | Henson | |
| 1,885,742 | A * | 11/1932 | MacChesney et al. | 254/230 |
| 3,572,398 | A * | 3/1971 | Sansum | 140/93.4 |
| 3,844,317 | A | 10/1974 | Angarola et al. | |
| 4,252,158 | A | 2/1981 | McDade | |
| 4,390,047 | A | 6/1983 | Kaneko | |
| 4,410,019 | A | 10/1983 | Suzuki | |
| 4,463,632 | A * | 8/1984 | Parke | 81/177.9 |
| 4,542,883 | A | 9/1985 | Rutzki | |
| 4,570,340 | A | 2/1986 | Shaw | |
| 4,688,607 | A | 8/1987 | Wolcott | |
| 4,718,460 | A | 1/1988 | Sato | |
| 4,726,403 | A | 2/1988 | Young et al. | |
| 4,928,738 | A | 5/1990 | Marelin et al. | |
| 5,027,867 | A | 7/1991 | O'Connor | |
| 5,127,446 | A | 7/1992 | Marelin | |
| 5,193,592 | A | 3/1993 | Evilsizer et al. | |
| 5,372,166 | A | 12/1994 | Lai | |
| 5,566,726 | A | 10/1996 | Marelin | |
| 5,743,310 | A | 4/1998 | Moran | |
| 5,944,944 | A | 8/1999 | Gwo-Jiang | |
| 6,014,792 | A | 1/2000 | Marelin et al. | |
| 6,053,076 | A * | 4/2000 | Barnes | 81/60 |
| 6,189,420 | B1 * | 2/2001 | Shiao | 81/60 |
| 6,499,172 | B1 | 12/2002 | McCracken | |
| 6,758,247 | B1 | 7/2004 | Thieme | |
| 2002/0108667 | A1 | 8/2002 | Thieme | |
| 2002/0179173 | A1 | 12/2002 | Marsche | |

FOREIGN PATENT DOCUMENTS

| | | |
|---|---|---|
| FR | 2 206 728 | 6/1974 |

OTHER PUBLICATIONS

Band-It Idex Corp. catalog, front cover, p. 14, p. 29 and back cover, 2001.

* cited by examiner

*Primary Examiner*—Lowell A. Larson
(74) *Attorney, Agent, or Firm*—Robert A. McCann; Aimee E. McVady

(57) ABSTRACT

An installation tool that is used to install a bundling member, such as a metal tie or strap, around a bundle of objects. The installation tool has a tool body, a front handle and an adjustable rear handle. The front handle is positioned within the tool body and the rear handle is pivotally connected to the tool body. The front handle includes a tensioning mechanism with a ratchet mechanism that tensions the bundling member around the bundle of objects to a predetermined tension setting. The front handle also includes a lockout mechanism that overrides the predetermined tension setting of the tension mechanism to enable the bundling member to be tensioned to a desired tension setting.

14 Claims, 22 Drawing Sheets

RATCHET STYLE INSTALLATION TOOL

CROSS-REFERENCE TO RELATED APPLICATIONS

Applicants claim, under 35 U.S.C. § 119(e), the benefit of priority of the filing date of Dec. 2, 2003, of U.S. Provisional Patent Application Ser. No. 60/526,222, filed on the aforementioned date, the entire contents of which are incorporated herein by reference.

FIELD OF THE INVENTION

The present invention relates to an installation tool, and more particularly, to an installation tool having an adjustable handle and an improved tensioning mechanism for controlling the tension in metal ties or metal strapping installed around a bundle.

BACKGROUND OF THE INVENTION

As is well known to those skilled in the art, cable ties, or straps are used to bundle or secure a group of articles such as electrical wires and cables. Cable ties of conventional construction include a cable tie head and an elongated tail extending therefrom. The tail is wrapped around a bundle of articles and thereafter inserted through the passage in the head. The head of the cable tie typically supports a locking element which extends into the head passage and engages the body of the tail to secure the tail to the head.

In practice, the installer manually places the tie about the articles to be bundled, inserts the tail through the head passage and then manually tightens the tie about the bundle. At this point, a cable tie installation tool is used to tension the tie to a predetermined tension. The tools of the prior art, although capable of tensioning and thereafter severing the excess portion of the cable tie, typically have several disadvantages therewith.

It is therefore an object of the present invention to provide an installation tool with an improved tensioning mechanism.

It is another object of the present invention to provide an installation tool with an improved resistance mechanism that overrides the preset tension to provide variation in the tension applied to the tie or strap.

It is another object of the present invention to provide an installation tool with a handle that is easy to adjust.

SUMMARY OF THE INVENTION

The present invention is direct to an installation tool used to install a bundling member, for example a metal tie or strap, around a bundle of objects. The installation tool includes a tool body, a front handle and a rear handle. The front handle is positioned within the tool body and the rear handle is pivotally connected to the tool body. The front handle has a tensioning mechanism with a ratchet mechanism for tensioning the bundling member to a predetermined tensioned setting. The installation tool also includes a lockout mechanism for overriding the predetermined tensioned setting to enable the bundling member to be tension to a desired tensioned setting.

DETAILED DESCRIPTION OF PREFERRED EMBODIMENTS

Figure 24:
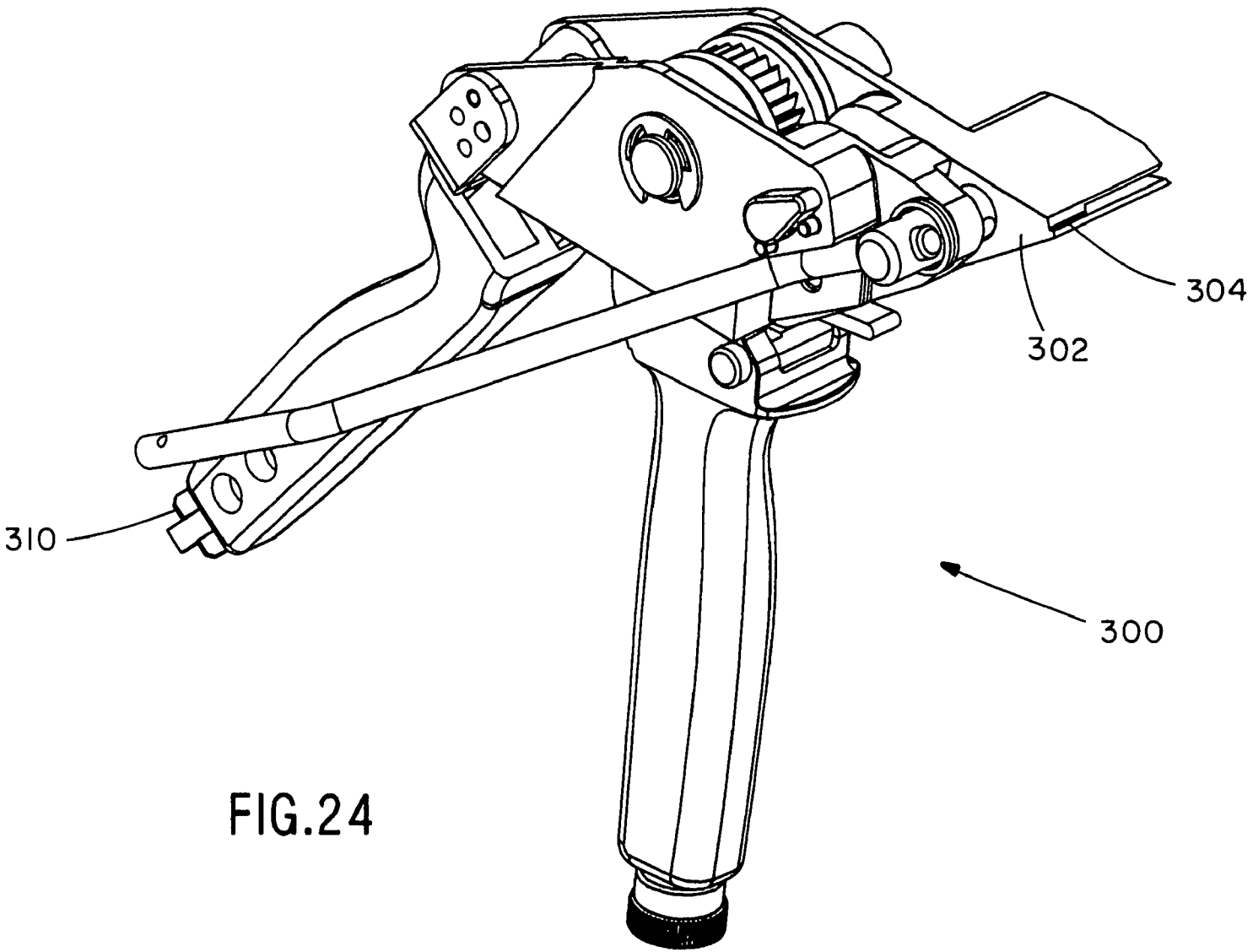
FIG. 24 is a right perspective view of the installation tool of the present invention used to install metal strapping.
Figure 25:
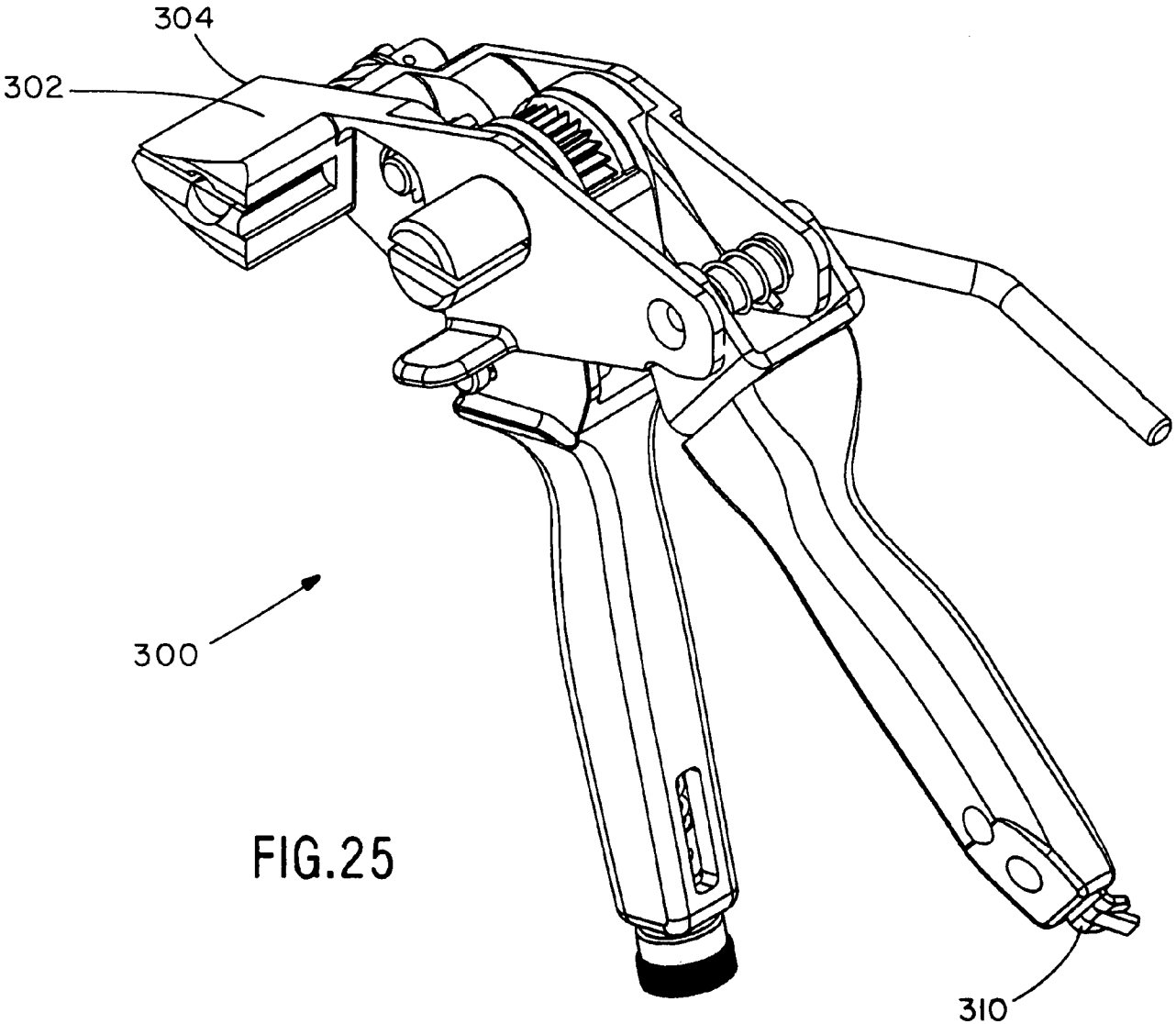
FIG. 25 is a left perspective view of the installation tool of FIG. 24.

The installation tool of the present invention, illustrated in general at 40, can be used to install a bundling member, such as metal ties or metal strapping, around a group of articles such as electrical wires or cables. The first embodiment of the installation tool of the present invention is illustrated in FIGS. 1–23 and is used to install metal ties. The second embodiment of the installation tool of the present invention is illustrated in FIGS. 24–25 and is used to install metal strapping. Each installation tool includes a tool body 42 with a front handle 120 having a tensioning mechanism and a lockout mechanism disposed therein, a cutting mechanism 240 pivotally connected to the tool body and an adjustable rear handle 260. The tool body 42 has a left member 44 with an inner side 46 and an outer side 48 and a right member 74 with an inner side 76 and an outer side 78.

As shown in FIGS. 1, 2, 5 and 6, the left member 44 of the tool body includes a nose 50, an indented portion 52, a main portion 54 and an end portion 56. The outer side 48 of the nose 50 has an outwardly extending housing 58 with a cavity 60 that receives a rotary cutter 242 for cutting the metal ties. The nose 50 of the left member of the tool body of the installation tool used to install metal ties is shorter than the nose 302 of the installation tool used to install metal strapping (see FIGS. 24–25) to enable the rotary cutter 242 to cut the metal tie close to the metal tie head.

The indented portion 52 is located between the nose 50 and the main portion 54 of the tool body such that the indented portion 52 extends inwardly from the inner side 46 of the left member 44. The indented portion 52 also includes a number of holes 62 for receiving fasteners to connect the members of the tool body to each other. The outer side 48 of the main portion 54 includes an outwardly extending finger guard 64 that is positioned along the bottom of the main portion 54. The main portion 54 also includes a central hole 66 that is sized to receive a mandrel 168 that winds the metal tie as it is tensioned by the tensioning mechanism of the present invention. The end portion 56 includes a shaft 68 and an adjustment pin 70 that extends from the inner side 46 of the end portion 56. The shaft 68 supports the adjustable rear handle 260 and the adjustment pin 70 acts in conjunction with an adjustment pin 108 extending from the right member 74 of the tool body to secure the rear handle 260 in various positions.

As illustrated in FIGS. 3–6, the right member 74 of the tool body has a slightly different shape than that of the left member 44 of the tool body. The right member 74 of the tool body also includes a nose 80, an indented portion 82, a main portion 84 and an end portion 86. The nose 80 is indented from the main portion 84 providing an open area for the cutting mechanism 240 to rotate when the cutter lever arm 258 is engaged. The nose 80 includes a hole 88 sized to receive the rotary cutter 242 that is also disposed within the housing 58 extending from the left member 44 of the tool body 42. The main portion 84 of the right member 74 includes a front hole 90 positioned near the front edge 92 of the main portion 84 and a central hole 98 positioned near the center of the main portion 84. Pins 96 extend outwardly from the outer side 78 of the main portion 84. The pins 96 are positioned near the front hole 90 to control the movement of the holding pawl release lever 192. As discussed below, when the holding pawl release lever 192 is rotated, the holding pawl release 190 attached to the holding pawl release lever also rotates.

Figure 6:
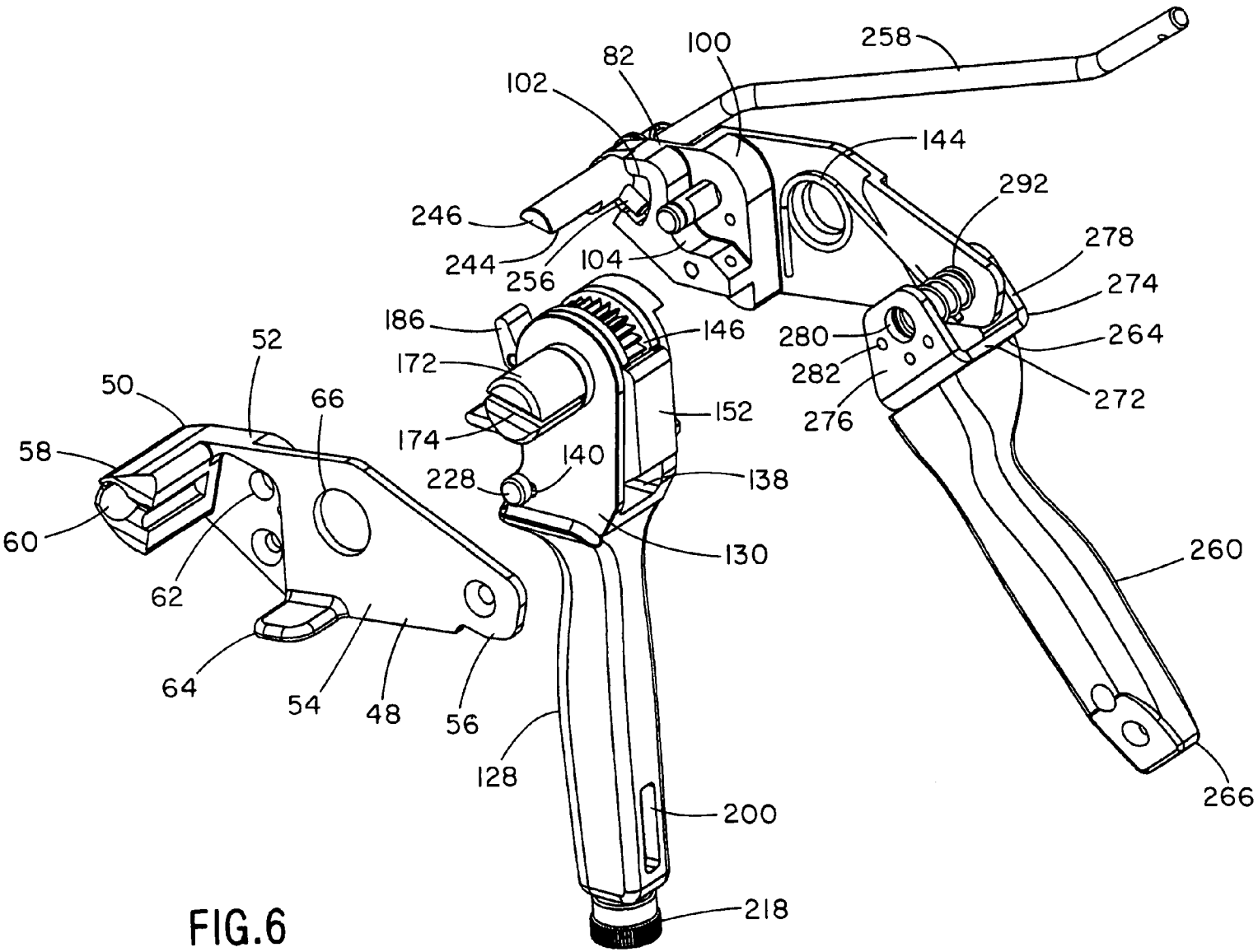
FIG. 6 is a partially assembled perspective view of the installation tool of FIG. 1.
Figure 7:
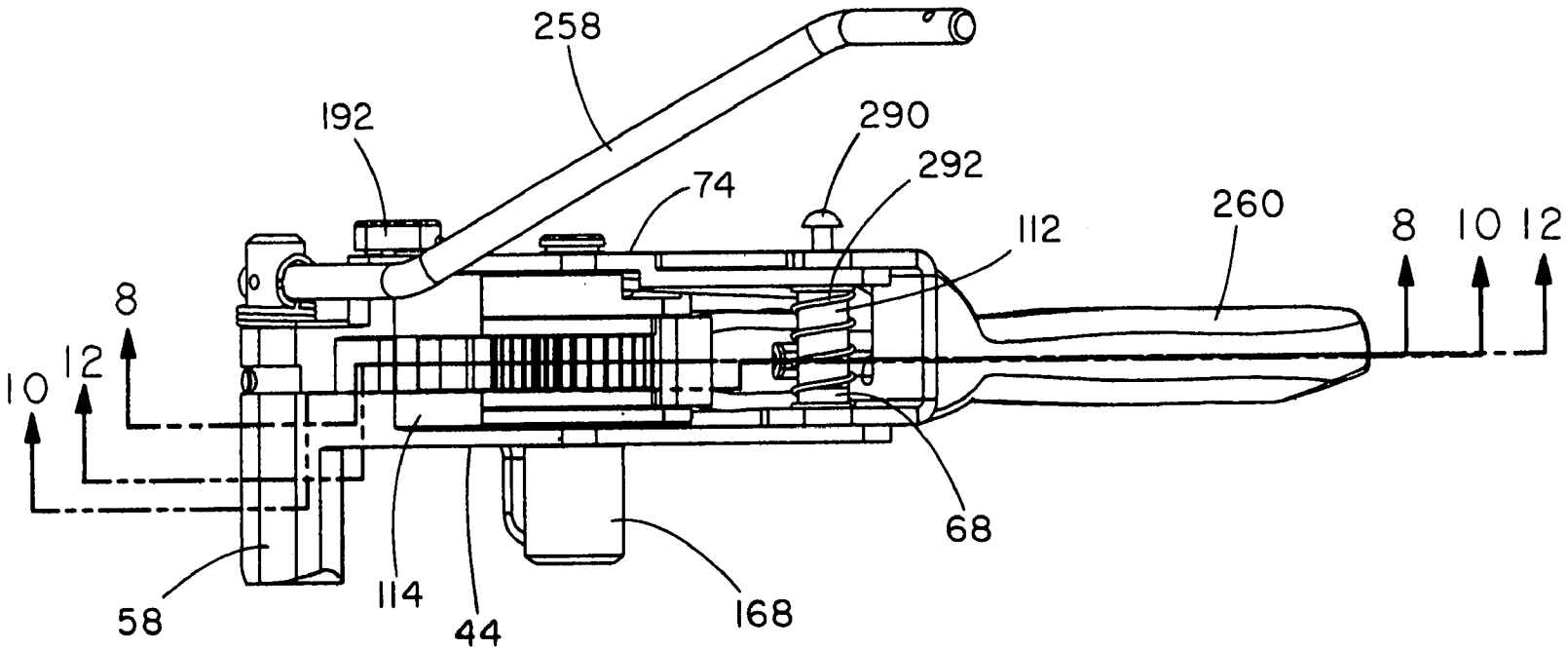
FIG. 7 is a top plan view of the installation tool of FIG. 1.

As shown in FIG. 6, the inner side 76 of the right member 74 includes an extension section 100 that extends inwardly from the main portion 84 of the tool body. The extension section 100 is formed with a generally C-shaped path 102 and a generally arcuate path 104. The generally C-shaped path 102 limits the rotation of the rotary cutter 242 and the generally arcuate path 104 defines the area in which the holding pawl release 190 rotates.

The end portion 86 is slightly indented from the outer side 78 of the main portion 84 such that there is a step 106 between the outer side of the main portion 84 and the outer side of the end portion 86. The outer side of the end portion 86 includes an outwardly extending adjustment pin 108 and a hole 110 for receiving a securing pin 290. The inner side of the end portion 86 includes an inwardly extending shaft 112. The shaft 112 supports the adjustable rear handle 260 along with the shaft 68 extending from the end portion of the left member.

Thus, as illustrated in FIGS. 1–4, in the assembled tool body, the inner side 46 of the left member 44 is disposed adjacent to the inner side 76 of the right member 74 so that the holes in the left member are aligned with the holes in the right member. More specifically, the indented portion 52 of the left member 44 of the tool body and the indented portion 82 of the right member 74 of the tool body are positioned adjacent each other thereby defining an opening 114 between the inner sides of the main portions 54, 84 of the left and right members, respectively. Additionally, the shafts 68 and 112 that extend inward from the end portions 56, 86 of the left and right member, respectively, engage. The opening 114 between the main portions houses the tensioning mechanism, including a portion of the front handle, while the shafts of the end portions support the rear handle.

Figure 5:
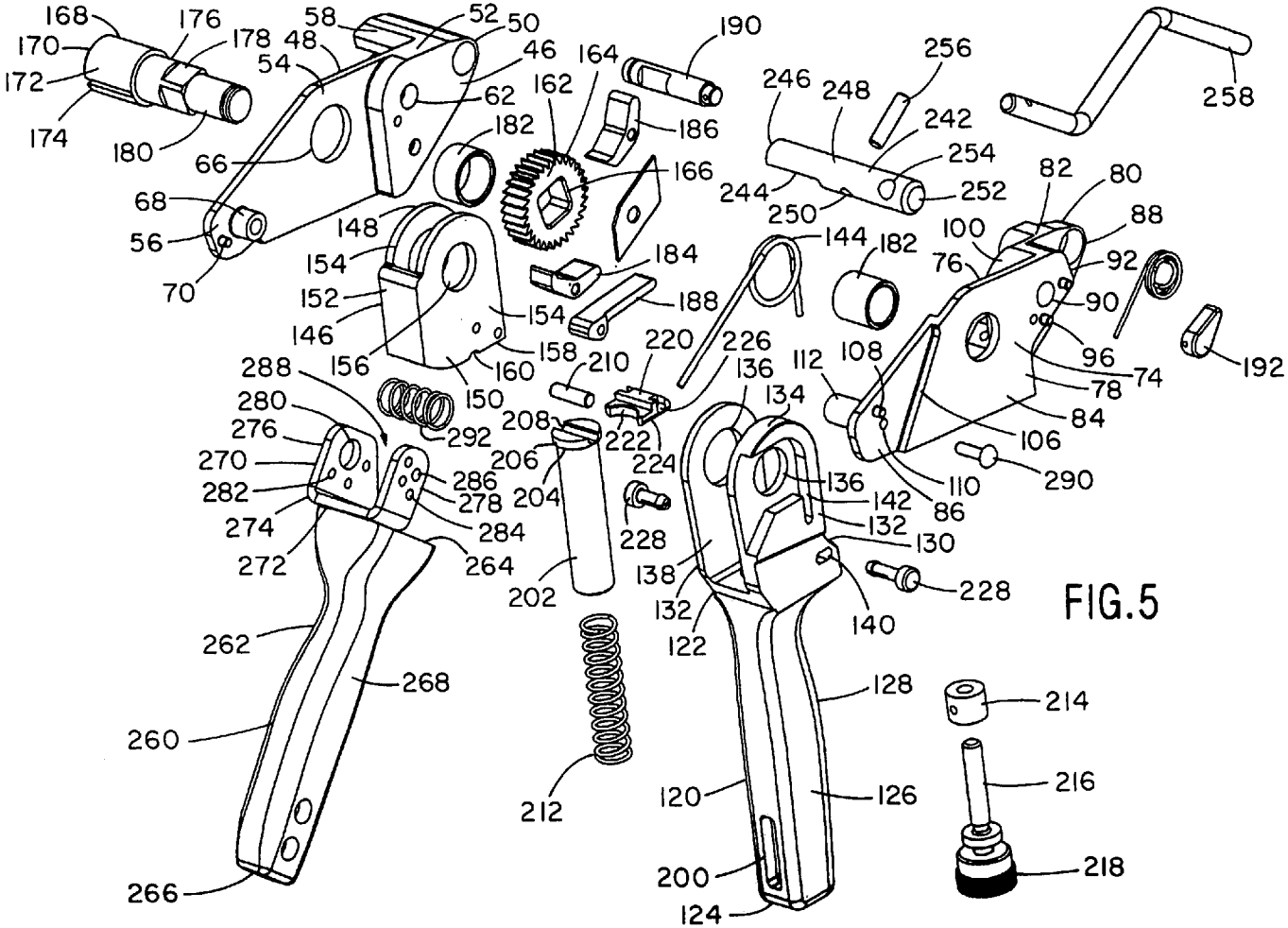
FIG. 5 is an exploded perspective view of the installation tool of FIG. 1.

As illustrated in FIG. 5, the front handle 120 of the present invention includes a top 122, a bottom 124 and sides 126 forming an ergonomic designed handle grip 128. A front handle adapter 130 extends upwardly from the top of the front handle grip. The front handle adapter 130 includes two arms 132 with a channel 138 therebetween. The arms 132 have an arch shaped top 134 and a central hole 136. Each arm 132 of the front handle adapter also includes a slot 140 for receiving a lockout pin 228 that engages a lockout device 220 positioned between the arms 132 of the front handle adapter 130. The right side of the front handle adapter 130 has an open portion 142 that houses a spring 144 to control the rear handle 260 once placed in the desired position with respect to the tool body 42.

As illustrated in FIG. 6, a ratchet housing 146 is disposed within the channel 138 between the arms 132 of the front handle adapter 130. The ratchet housing 146 has a shape that compliments the shape of the front handle adapter 130. More specifically, as illustrated in FIG. 5, the ratchet housing 146 includes an arched shaped top 148, a bottom 150, a back 152 and two sides 154. Each side 154 includes a central hole 156 that becomes aligned with the central hole 136 in the front handle adapter 130 when the ratchet housing 146 is disposed in the channel 138 of the front handle adapter 130. Each side 154 also includes a groove 160 formed in the bottom edge 158 of the side 154.

A ratchet wheel 162 having teeth 164 disposed around the circumference of the wheel is positioned within the ratchet housing 146. The ratchet wheel 162 also includes a central opening 166. The opening 166 is rectangular, however, it is contemplated that the ratchet wheel be designed with a central opening having a different shape. When the ratchet wheel 162 is installed in the ratchet housing 146, the opening 166 in the ratchet wheel 162 becomes aligned with the central hole 156 in the ratchet housing 146 and the central hole 136 in the front handle adapter 130.

As illustrated in FIG. 6, a mandrel 168 is positioned through the central holes 136 in the arms 132 of the front handle adapter 130, the central holes 156 in the sides 154 of the ratchet housing 146 and the opening 166 in the ratchet wheel 162. The first end 170 of the mandrel includes a cylindrical portion 172 with a slot 174 extending the length of the cylindrical portion (see FIG. 5). The slot 174 is located in the center of the cylindrical portion 172 for receiving the metal tie that is to be installed. The mandrel 168 also includes a second cylindrical portion 176 having a smaller circumference than the first cylindrical portion 172, a rectangular portion 178 and a third cylindrical portion 180 having a circumference less than that of the first and second cylindrical portions. When the mandrel 168 is positioned through the front handle adapter 130, the rectangular portion 178 of the mandrel 168 engages the rectangular opening 166 in the ratchet wheel 162. As a result, when the ratchet wheel 162 is rotated, the mandrel 168 is also rotated. It is also contemplated that if the opening in the ratchet wheel is formed from a different shape, the mandrel will be formed with a portion having a complementary shape.

Sleeve bearings 182 are installed on the smaller two cylindrical portions of the mandrel such that the sleeve bearings 182 are placed between the mandrel 168, the tool body 42, the ratchet housing 146 and the front handle adapter 130.

As illustrated in FIGS. 8–14, the ratchet wheel 162 and attached mandrel are advanced by a driving pawl 184 that is positioned within the ratchet housing 146 to engage the lower teeth 164 of the ratchet wheel 162. A holding pawl 186 is also positioned within the front handle adapter 130 to engage the ratchet wheel 162 and prevent the ratchet wheel 162 and attached mandrel 168 from unwinding. The driving pawl 184 and the holding pawl 186 are held in engagement with the ratchet wheel by springs 185, 187, respectively. A driving pawl release lever 188 and a holding pawl release 190 are positioned adjacent to the driving pawl 184 and the holding pawl 186, respectively. When engaged, the driving pawl release lever 188 and the holding pawl release lever 192, which controls the holding pawl release 190, rotate the driving pawl 184 and the holding pawl 186 away from the ratchet wheel teeth 164. As a result, the ratchet wheel 162 and the attached mandrel 168 will no longer rotate.

The front handle 120 has a cavity 194 that extends from an opening 196 in the bottom of the front handle 120 to an opening 198 in the top of the front handle 120. The front handle 120 also includes a window 200 (see FIG. 1) for viewing a portion of the tension mechanism in the cavity 194. The cavity 194 of the front handle 120 houses a cylindrical plunger 202 having a flange 206 that extends from the top 204 of the plunger 202 and defines a channel 208 at the center of the top of the plunger 202. The channel 208 houses a detent roller 210 which engages the grooves 160 at the bottom 150 of the ratchet housing 146 when the installation tool is assembled. A tension adjustment spring 212 or a detent spring is disposed within the cavity 194 in the front handle 120. The tension adjustment spring 212 is positioned below the plunger 202 and a tension adjustment screw 216 is disposed within the tension adjustment spring 212. A tension adjustment block 214 and a knob 218 are interconnected with the tension adjustment screw and are disposed at the bottom of the cavity 194 of the front handle 120.

Figure 15:
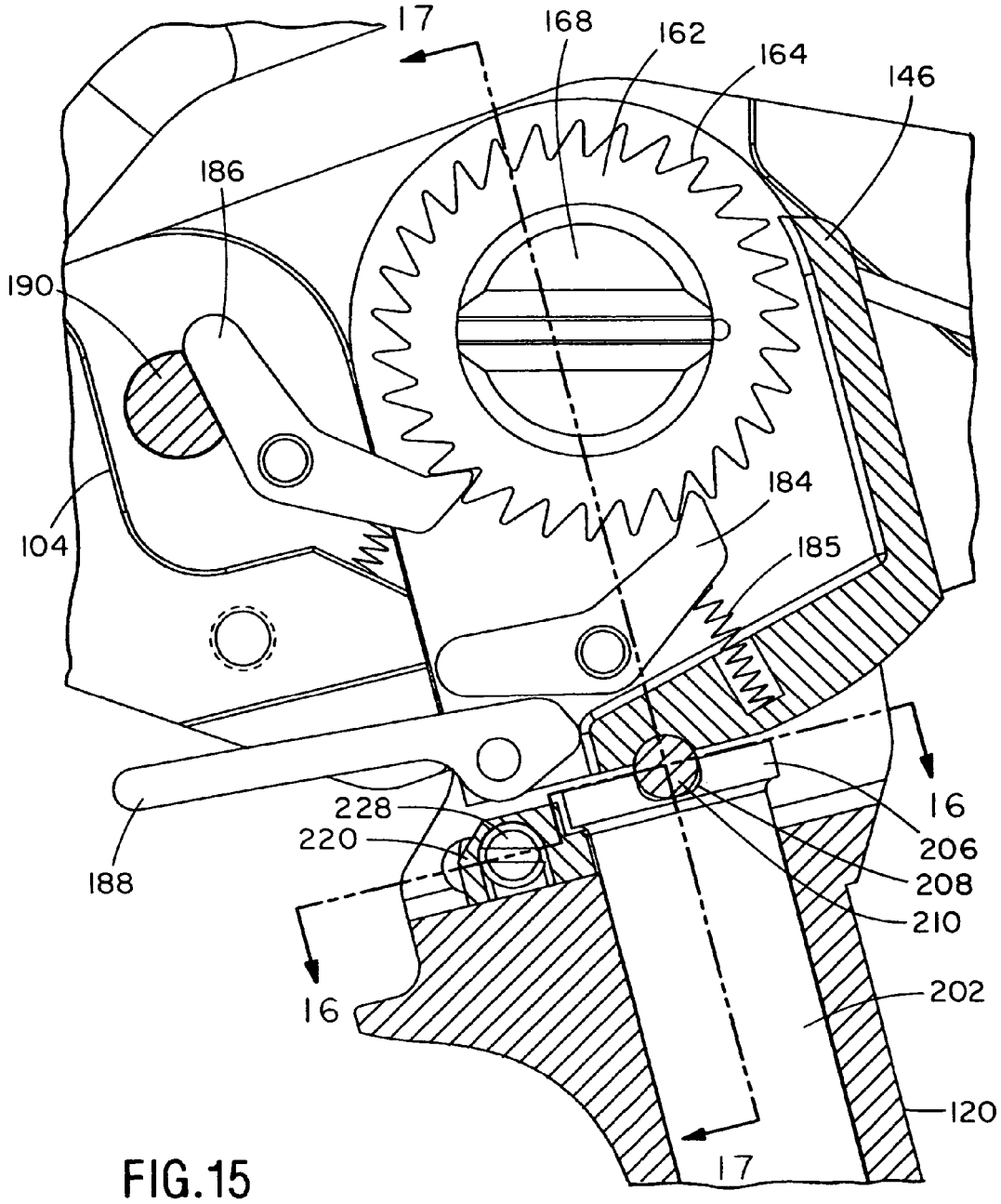
FIG. 15 is a cross sectional view of the installation tool of FIG. 10 with a lockout device being engaged.
Figure 16:
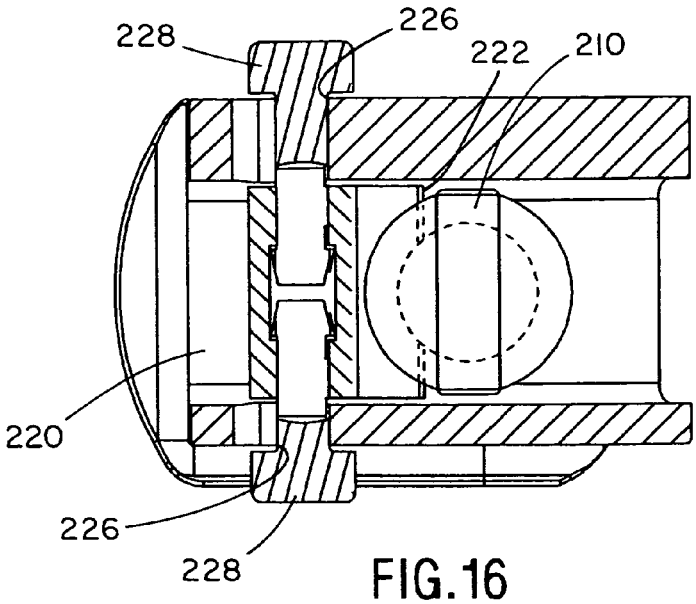
FIG. 16 is a cross sectional view of the installation tool with the lockout device engaged taken along line 16—16 of FIG. 15.
Figure 17:
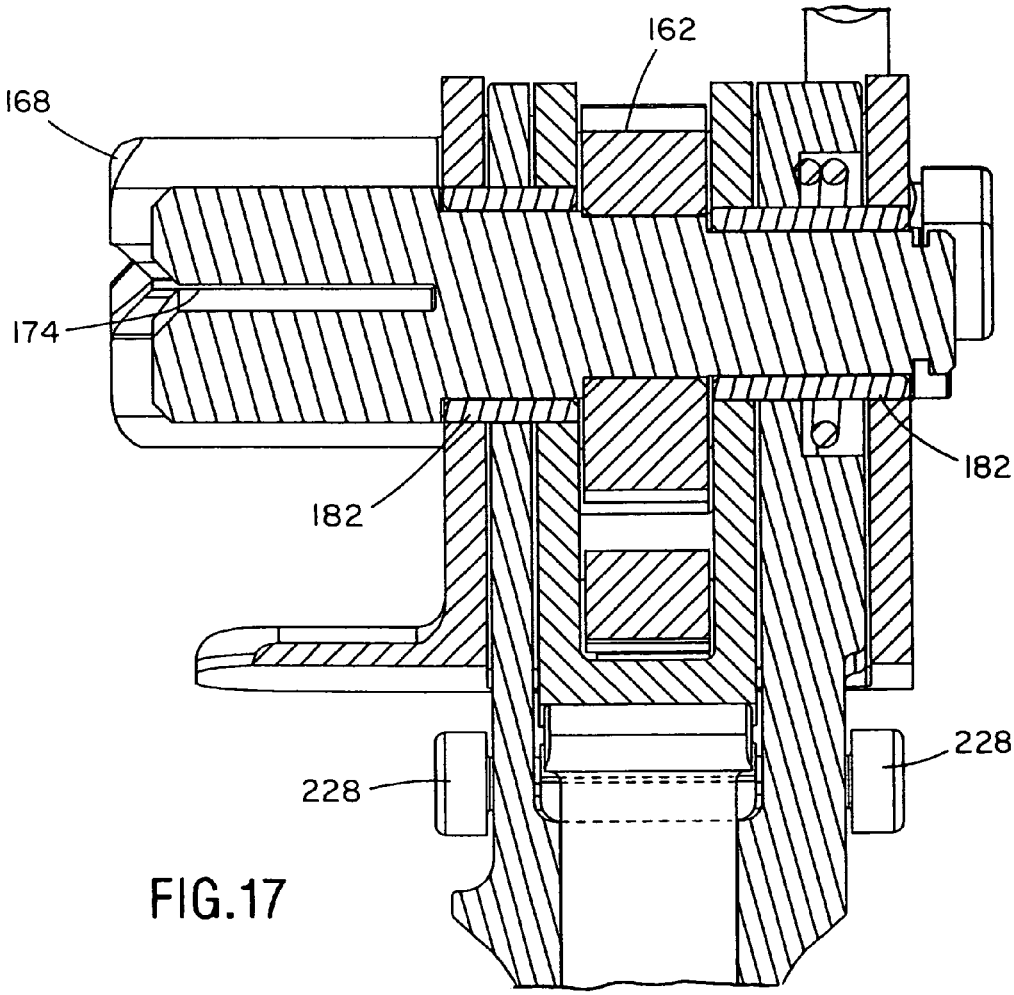
FIG. 17 is a cross sectional view of the installation tool with the lockout device engaged taken along line 17—17 of FIG. 15.

A lockout or retention device 220 is also disposed between the arms 132 of the front handle adapter 130 and positioned below the ratchet housing 146. As shown in FIG. 5, the lockout device 220 has an arcuate back portion 222 that engages the underside of the flange 206 at the top of the cylindrical plunger 202. Each side 224 of the lockout device 220 includes an opening 226 that is sized to receive a lockout pin 228. The openings 226 are positioned such that they oppose each other. Lockout pins 228 are inserted through the slots 140 in the front handle adapter 130 and remain disposed within one of the opposed openings 226 in the lockout device 220. The lockout pins 228 slide within the slots 140 thereby enabling the lockout device 220 to slidingly engage the plunger 202. When the lockout device 220 is slid towards the rear of the tool, the arcuate back portion 222 engages the plunger 202 and a portion of the flange 206 of the plunger 202 rests on top of the lockout device 220 as shown in FIG. 15.

Figure 1:
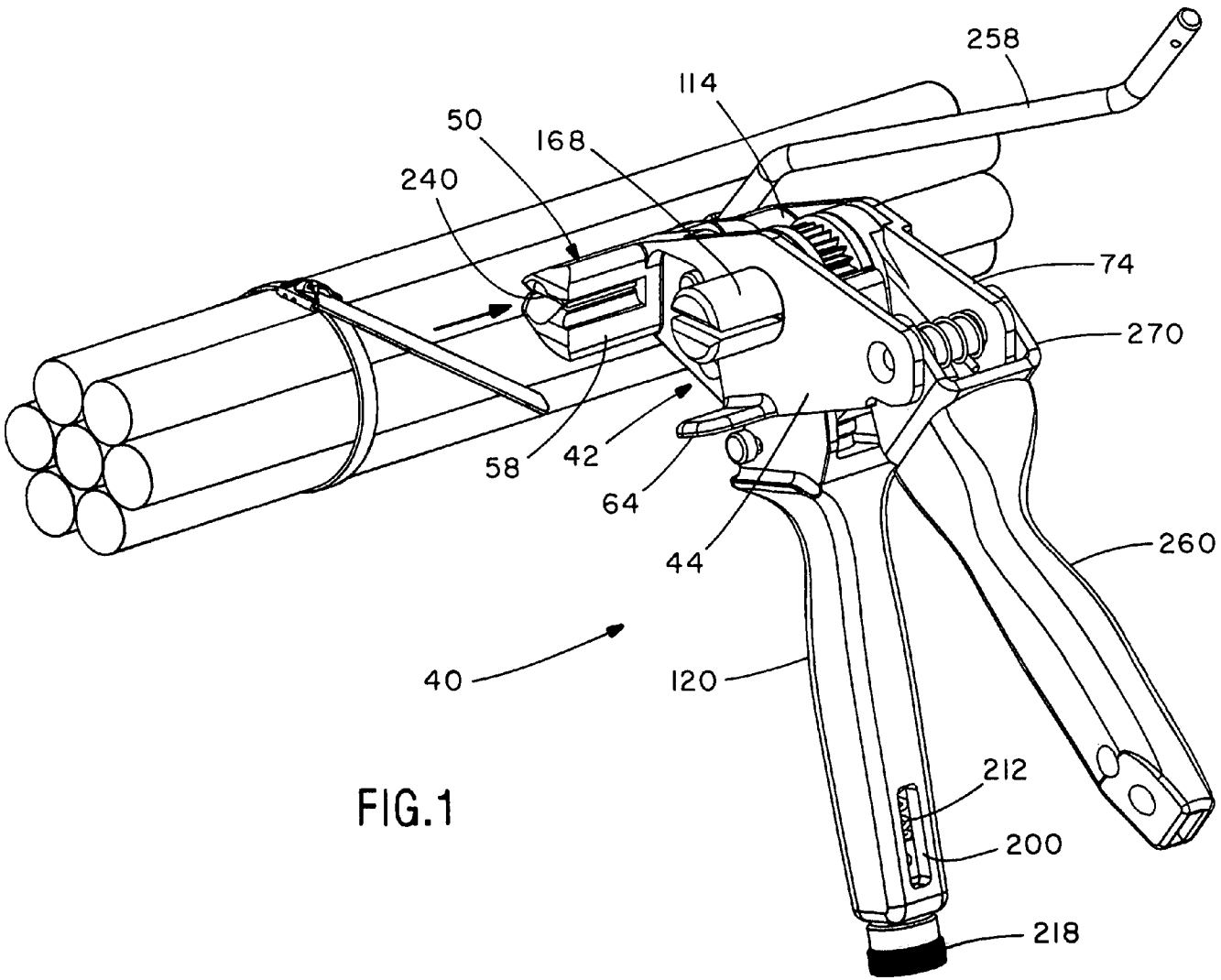
FIG. 1 is a perspective view of the installation tool of the present invention used to install metal ties.

The cutting mechanism 240 includes a rotary cutter 242 having a cutting edge 244 at a first end 246 (see FIG. 5). The rotary cutter 242 includes a first hole 250 located at approximately the middle 248 of the rotary cutter and a second hole 254 located near the second end 252 of the rotary cutter. A pin 256 is disposed through the first hole 250 so that it extends from the rotary cutter 242. The second hole 254 receives a cutter lever arm or handle 258. As illustrated in FIG. 1 and FIG. 24, the cutter lever arm may be positioned to extend in an upwards direction or in a downwards direction depending on whether the tool is being used to install metal ties or metal strapping, respectively.

Figure 2:
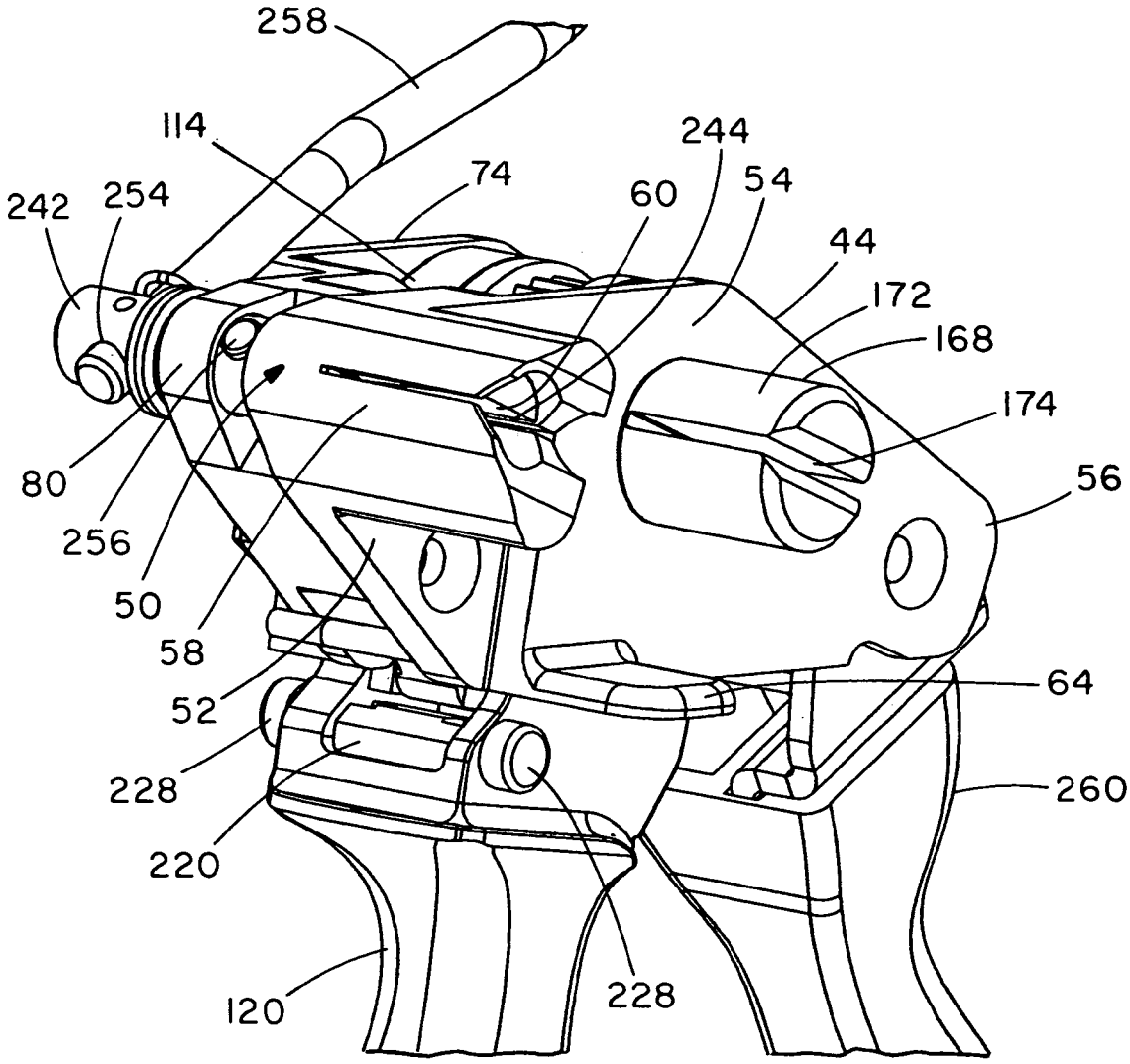
FIG. 2 is a left front perspective view of the upper portion of the installation tool of FIG. 1.
Figure 3:
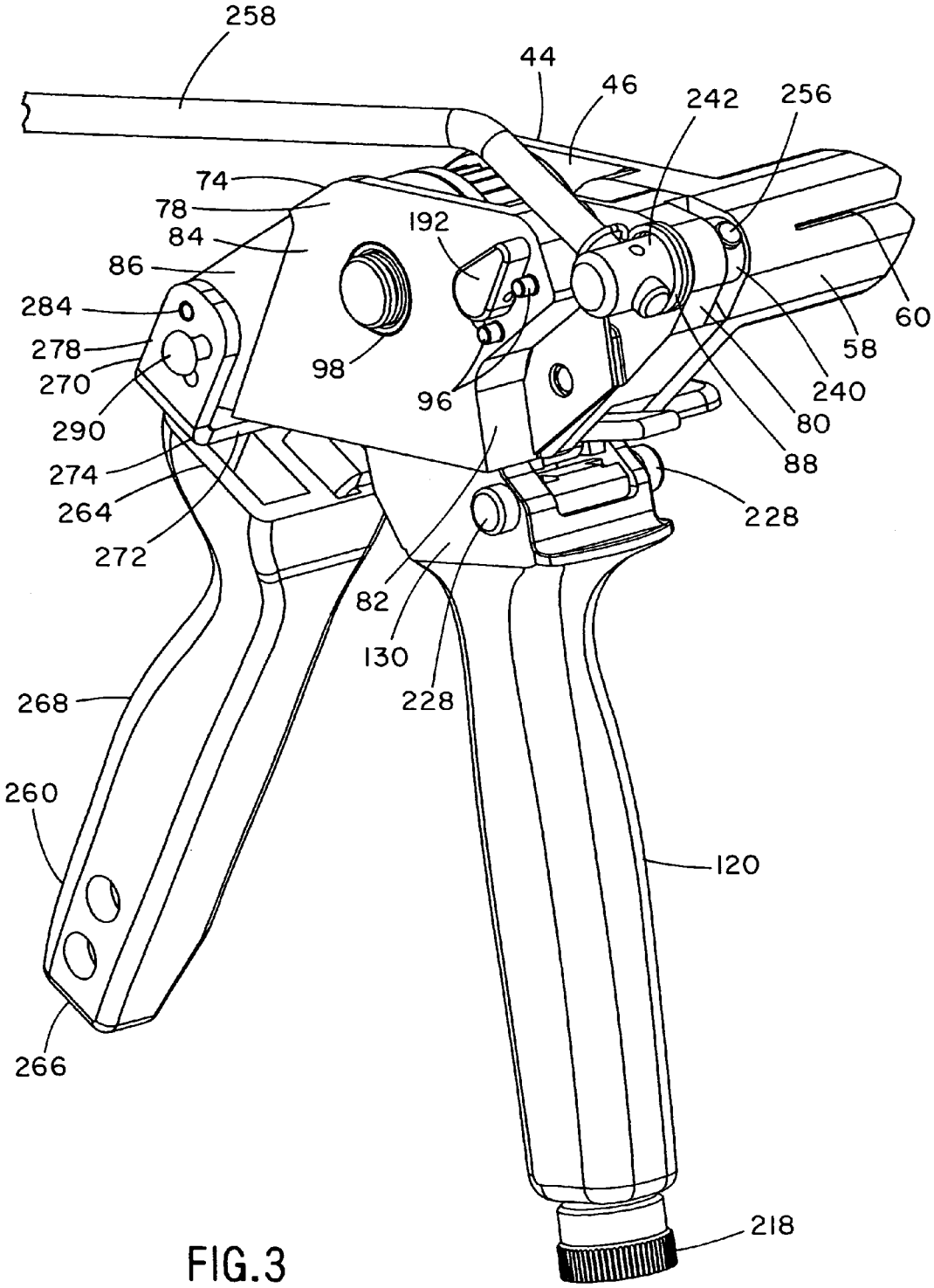
FIG. 3 is a right front perspective view of the installation tool of FIG. 1.
Figure 4:
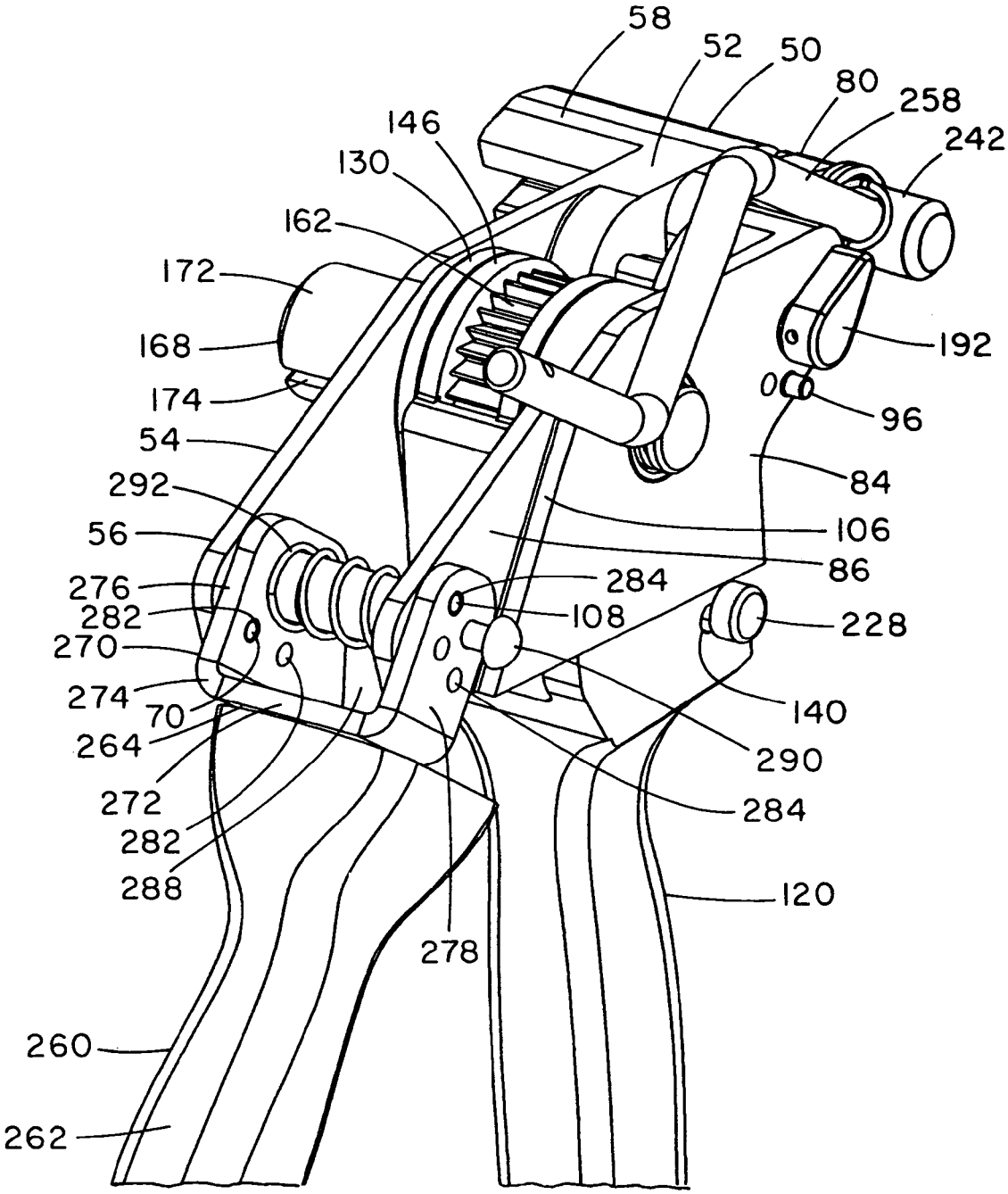
FIG. 4 is a right rear perspective view of the upper portion of the installation tool of FIG. 1.

A portion of the rotary cutter 242 is disposed in the hole of the nose of the tool body such that the second hole 254 and the cutter lever arm 258 are disposed outside the tool body adjacent to the outer side 78 of the right member 74 and the cutting edge 244 is positioned within the housing 58 that extends from the outer side 48 of the left member 44 of the tool body as shown in FIG. 2. The pin 256 that is inserted through the first hole 250 of the rotary cutter 242 is disposed within the C-shaped path 102 defined by the extension 100 of the right body member as illustrated in FIG. 6. The C-shaped path 102 limits the movement of the pin 256 thereby controlling the rotation of the rotary cutter 242.

Figure 23:
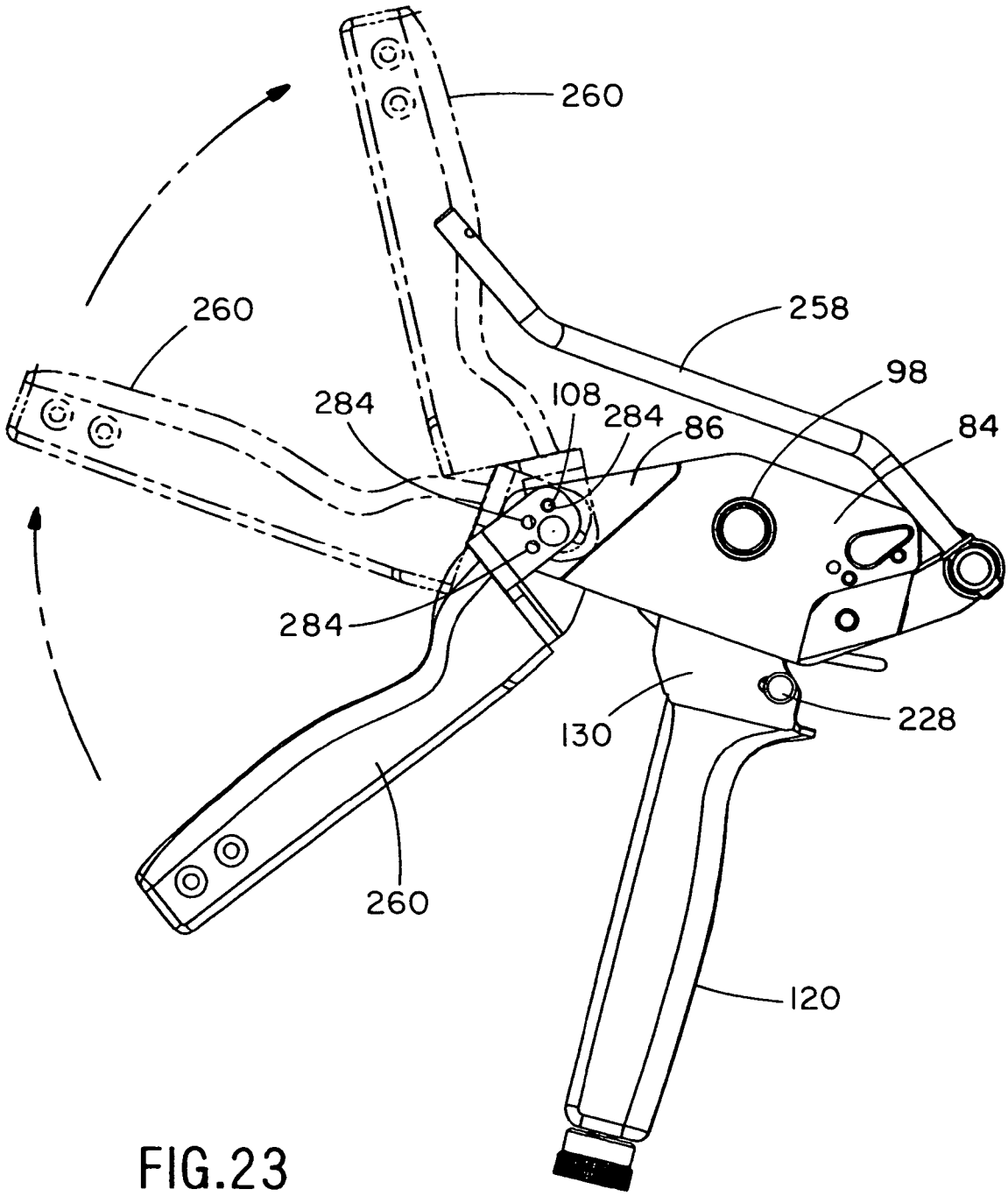
FIG. 23 is a side elevational view of the installation tool of FIG. 1 with the alternative positions of the rear handle illustrated in phantom.

The adjustment mechanism enables the rear handle 260 to be adjusted to various positions, as shown in FIG. 23. The rear handle 260 includes a handle grip 262 with a top 264, a bottom 266 and sides 268 (see FIG. 5). The sides 268 of the handle grip have an ergonomic design providing a comfortable and easy to hold handle grip. A rear handle stamping 270 is positioned at the top 264 of the rear handle 260. The rear handle stamping 270 includes a bottom 272 with an outer edge 274. A left arm 276 and an opposing right arm 278 extend upwardly from the outer edge 274 of the stamping defining a channel 288 therebetween. The left arm 276 includes a central hole 280 and a number of identical smaller holes 282, preferably three, that are positioned in a circular path around the bottom of the central hole 280. The central hole 280 is sized to receive the shafts 68, 112 that extend inwardly from the inner sides of the end portions of the tool body. The smaller holes 282 are designed to receive the adjustment pin 70 that extends inwardly from the inner side 46 of the end portion 56 of the left member of the tool body. The right arm 278 includes a number of smaller holes 284, 286 as illustrated in FIG. 5. Three of the smaller holes 284 are identical to each other and to the smaller holes 282 in the left arm. The smaller holes 284 in the right arm are designed to receive the adjustment pin 108 extending from the outer side 78 of the end portion 86 of the right member of the tool body. The fourth hole 286 in the right arm aligns with the hole 110 in the end portion of the right member to receive the securing pin 290 that secures the rear handle to the tool body.

When the rear handle 260 is connected to the tool body, the left arm 276 of the rear handle stamping is positioned between the inner sides of the end portions of the tool body and the right arm 278 is positioned adjacent to the outer side of the end portion of the right member of the tool body. A spring 292 is situated on the shafts 68, 112 extending between the left arm 276 of the rear handle stamping and the inner side 76 of the right member of the tool body. As will be described with reference to FIGS. 19–23, the geometry of the rear handle is such that the smaller holes in the arms, the adjustment pins and the securing pin enable the rear handle to be adjusted and secured in a number of desired positions.

As discussed above, the hand installation tool of the present invention is used to install metal ties or strapping around a bundle of objects. Although the shape of the nose of the tool body and the placement of the cutting lever arm differs in the installation tools, the tensioning mechanism, the cutting mechanism, the lockout mechanism and the rear handle adjustment mechanism of the installation tools are identical and work in the same manner.

To prepare the installation tool, the user would first assemble the metal tie or strapping around a bundle of objects. The metal strapping is also threaded through a buckle. Next, the tip of the tie or strap is threaded through the nose and the center slot in the mandrel of the installation tool. Once the tie or strapping is installed on the tool, the front handle may be actuated to increase the tension of the tie or strap around the bundle. FIGS. 8–14 illustrate the metal tie being tensioned as the user engages the front handle of the installation tool. While the tension of the installation tool for the metal tie is described below, the installation tool for the strapping would tension the metal strapping in the same fashion.

Figure 8:
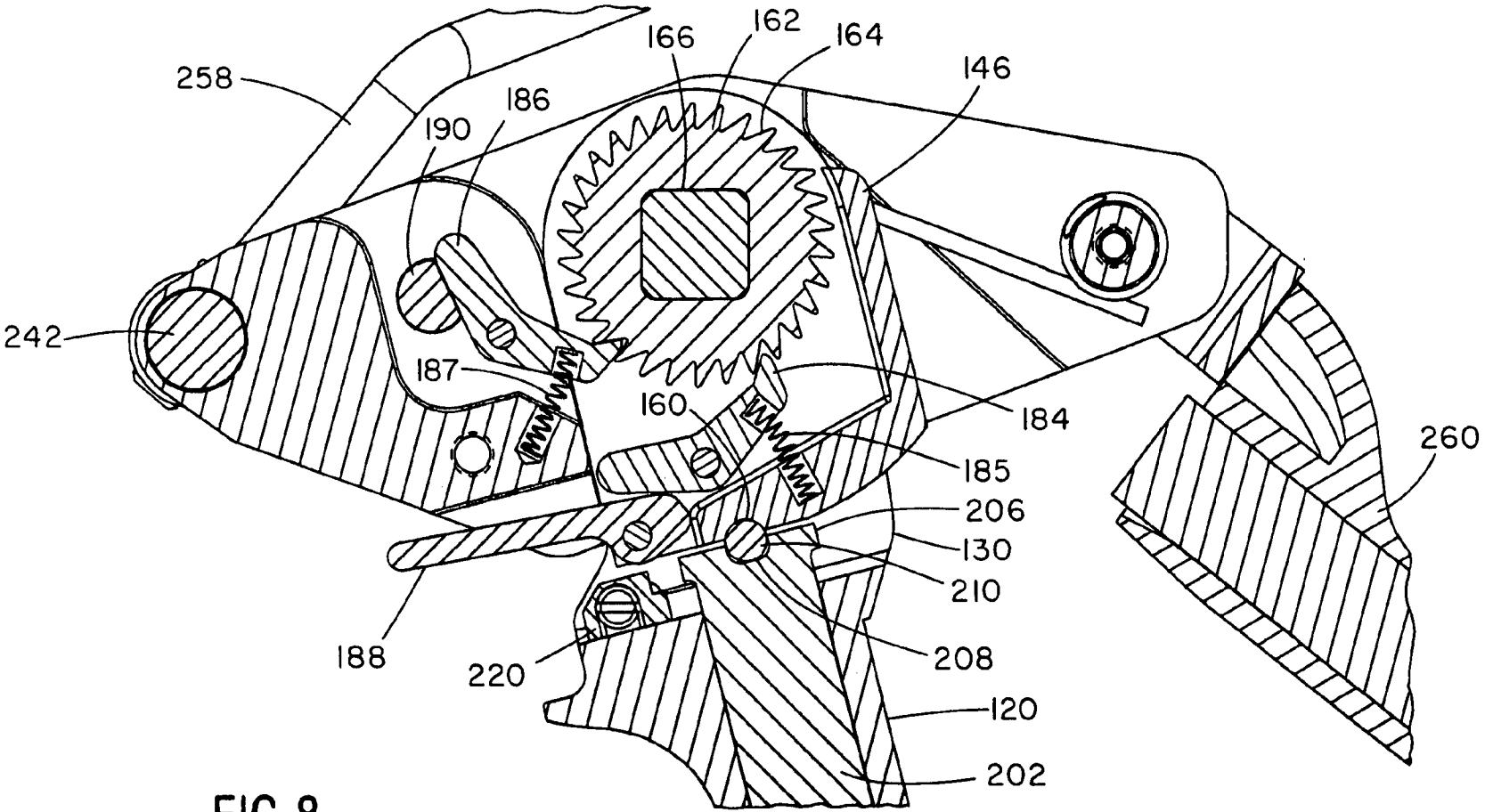
FIG. 8 is a cross sectional view of the upper portion of the installation tool taken along line 8—8 of FIG. 7.
Figure 9:
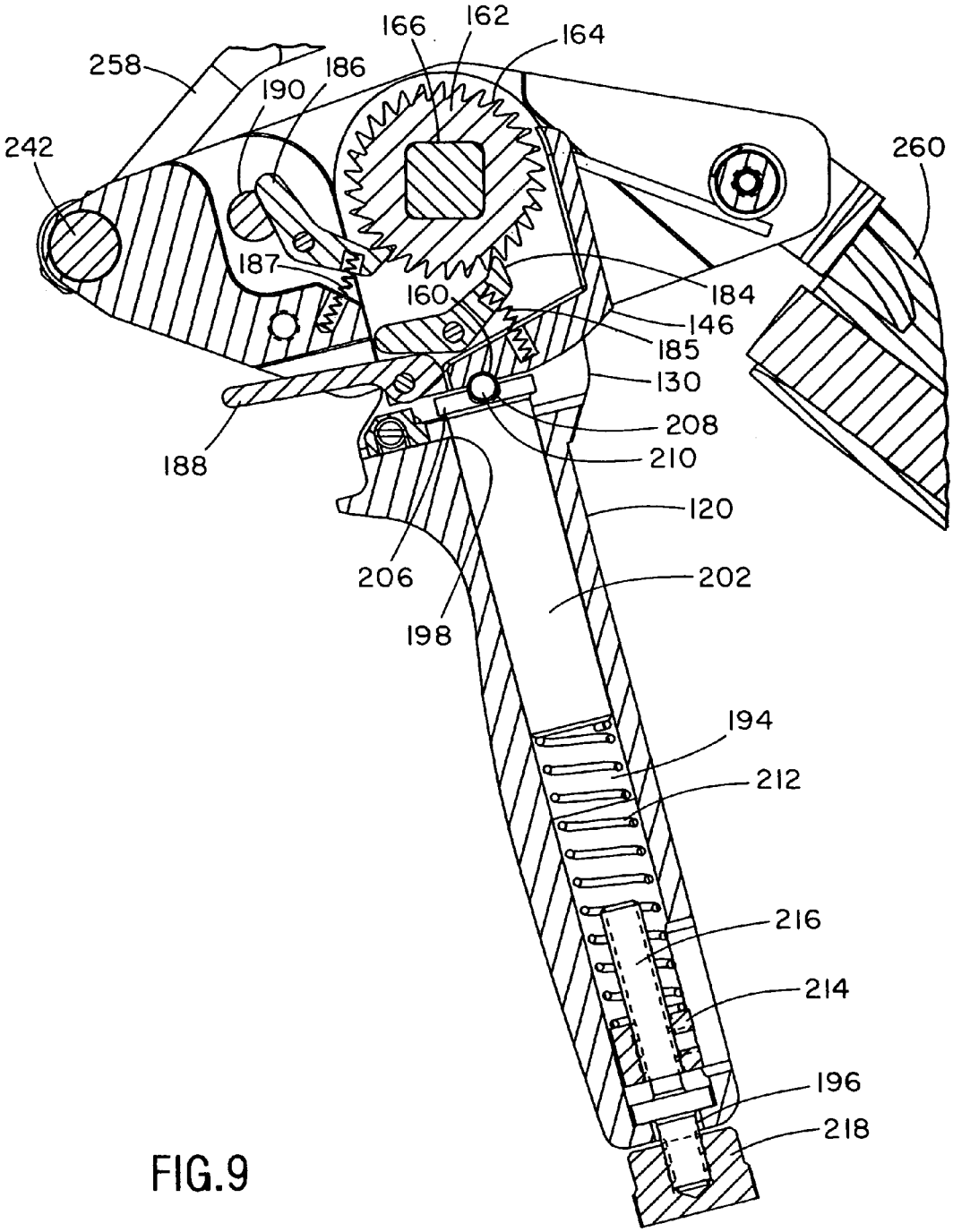
FIG. 9 is a cross sectional view of the tool body and the front handle of the tool taken along line 8—8 of FIG. 7.
Figure 10:
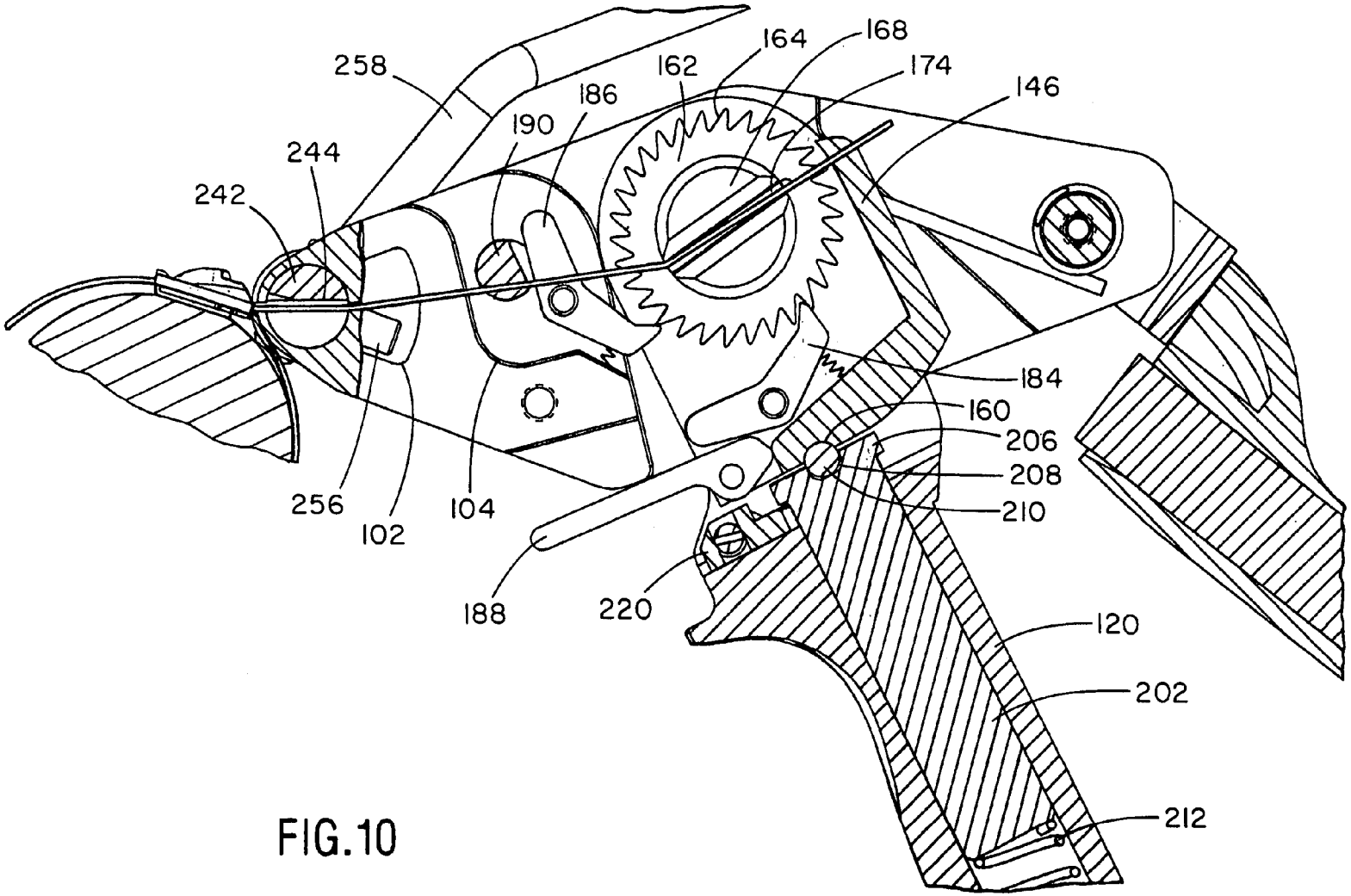
FIG. 10 is a cross sectional view of the installation tool taken along line 10—10 of FIG. 7.
Figure 11:
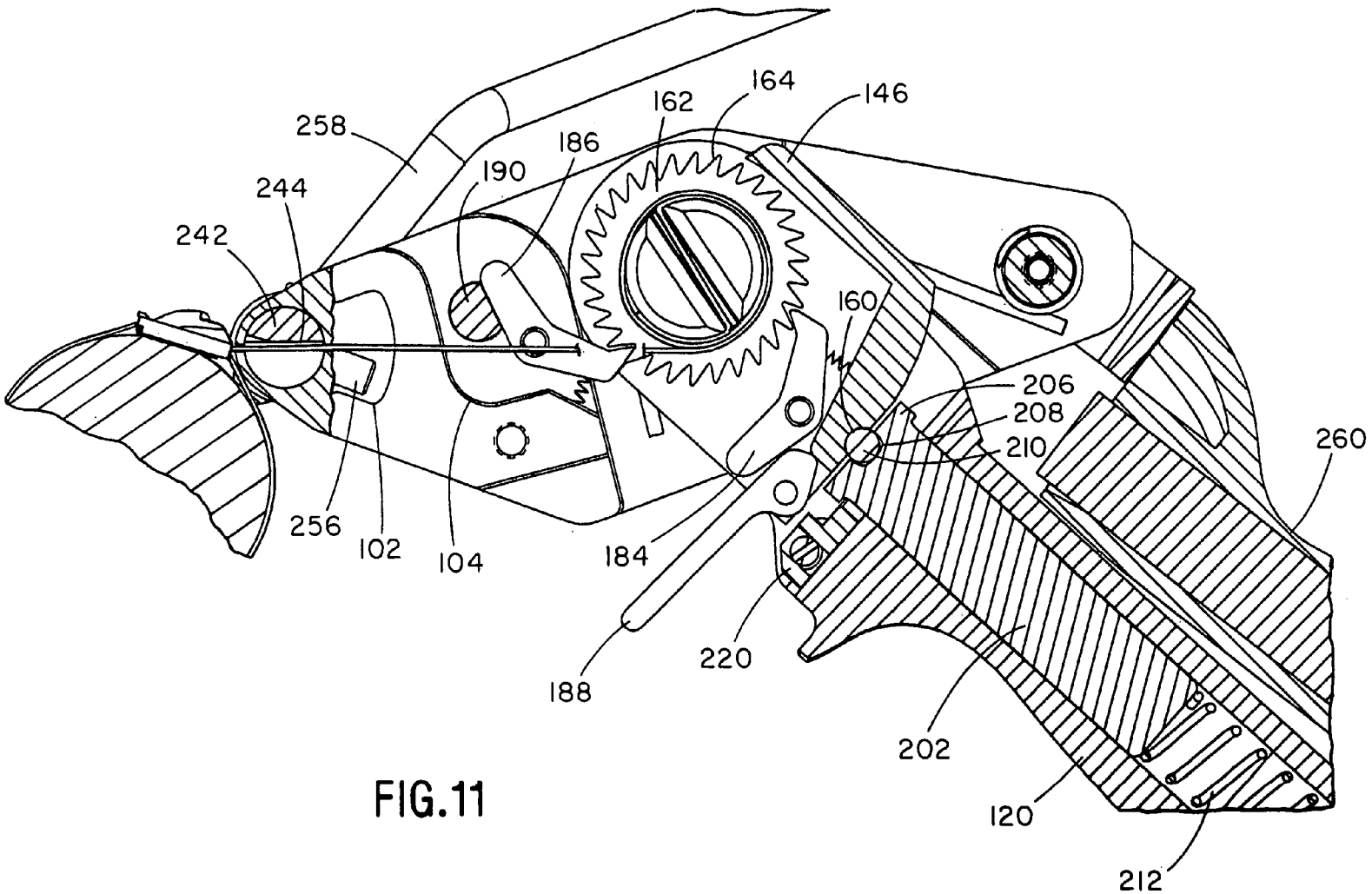
FIG. 11 is a cross sectional view of the installation tool of FIG. 10 with the front handle actuated toward the rear of the tool.

In the installation tool's initial position, as shown in FIGS. 8 and 9, the spring 212 inside the front handle 120 pushes the plunger 202 upwards towards the ratchet housing 146. As a result, the detent roller 210 positioned within the flange 206 at the top of the plunger 202 engages the grooves 160 in the bottom edge 158 of the ratchet housing 146. In this initial position, the driving pawl 184 and the holding pawl 186 engage one of the teeth 164 in the ratchet wheel 162. As the front handle 120 is actuated and pulled towards the rear of the installation tool, the detent roller 210 positioned within the grooves 160 forces the ratchet housing 146 to rotate towards the rear of the tool along with the front handle 120. The sleeve bearings 182 transfer the load of the spring 212 to the tool body allowing the front handle 120 and attached mandrel 168 to easily rotate. As shown in FIG. 10, when the ratchet housing 146 rotates, the driving pawl 184 rotates the ratchet wheel 162 and the connected mandrel 168 causing the attached tie to wind around the mandrel 168. FIG. 11 illustrates the front handle 168 further actuated with the driving pawl 184 advanced along the ratchet wheel 162 to rotate the ratchet wheel 162 enabling an additional portion of the tie to be wound around the mandrel 168.

Figure 12:
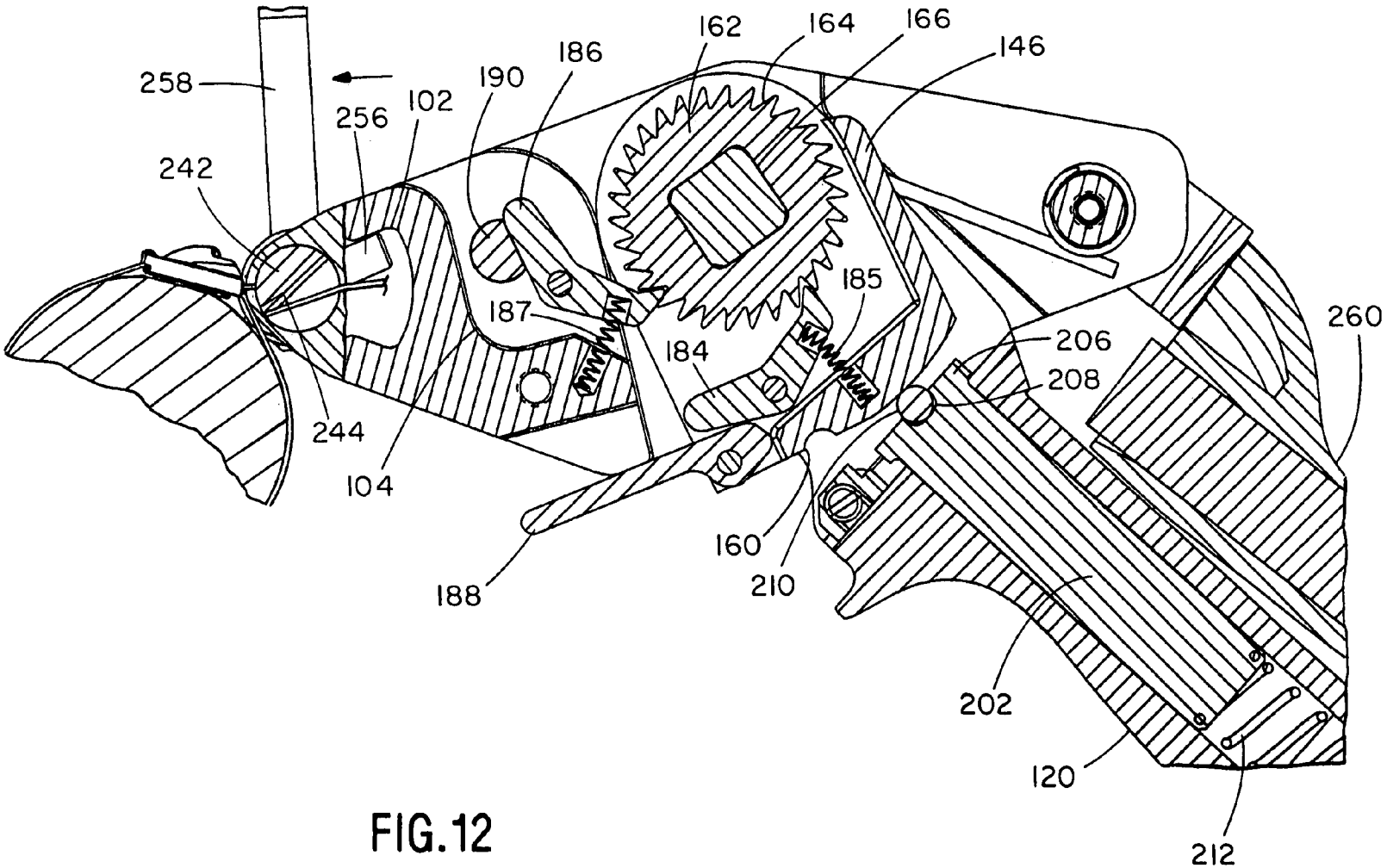
FIG. 12 is a cross sectional view of the installation tool taken along line 12—12 of FIG. 7 with the front handle actuated and the detent released.
Figure 13:
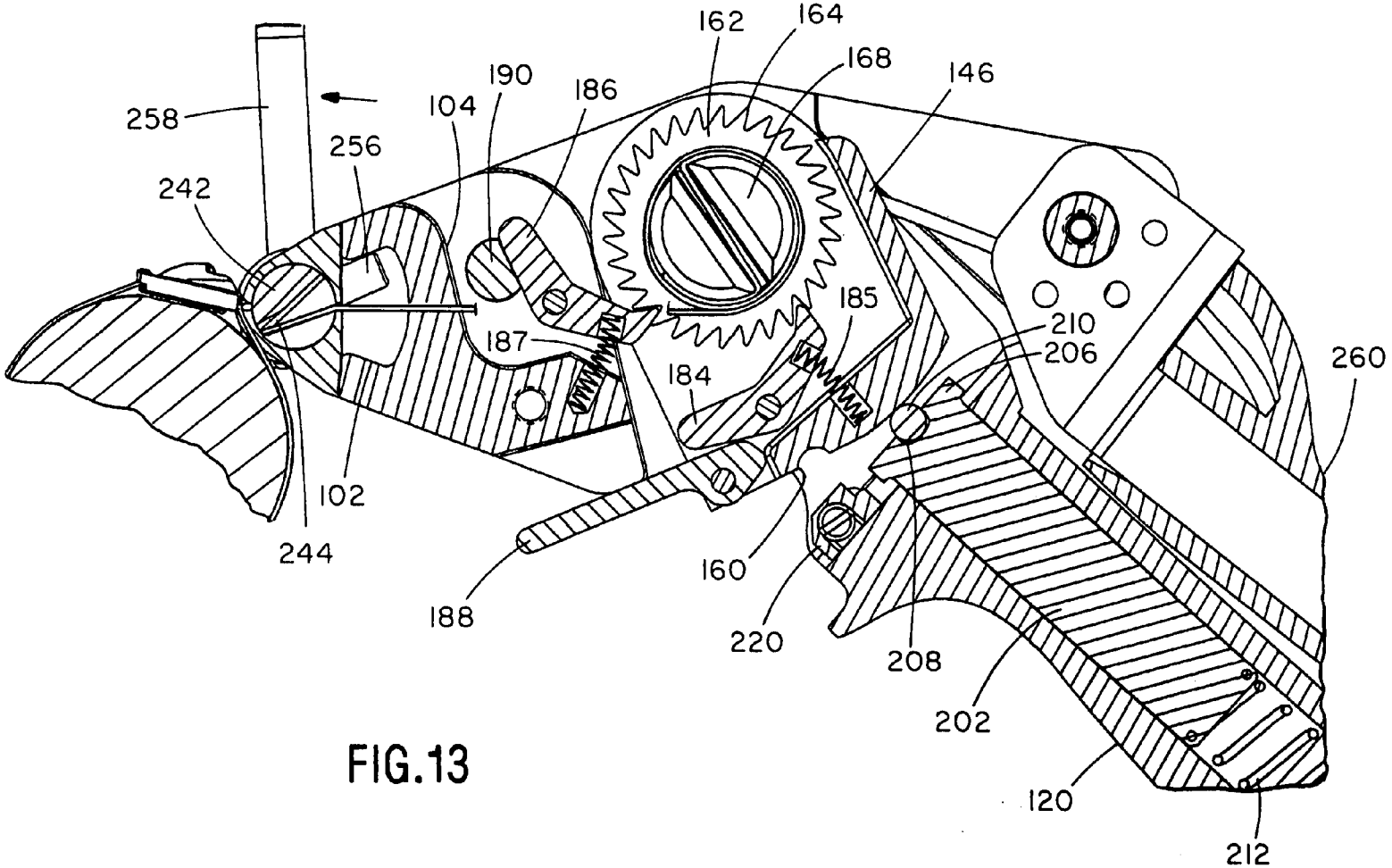
FIG. 13 is a cross sectional view of the installation tool of FIG. 10 with the front handle actuated and the detent released.
Figure 14:
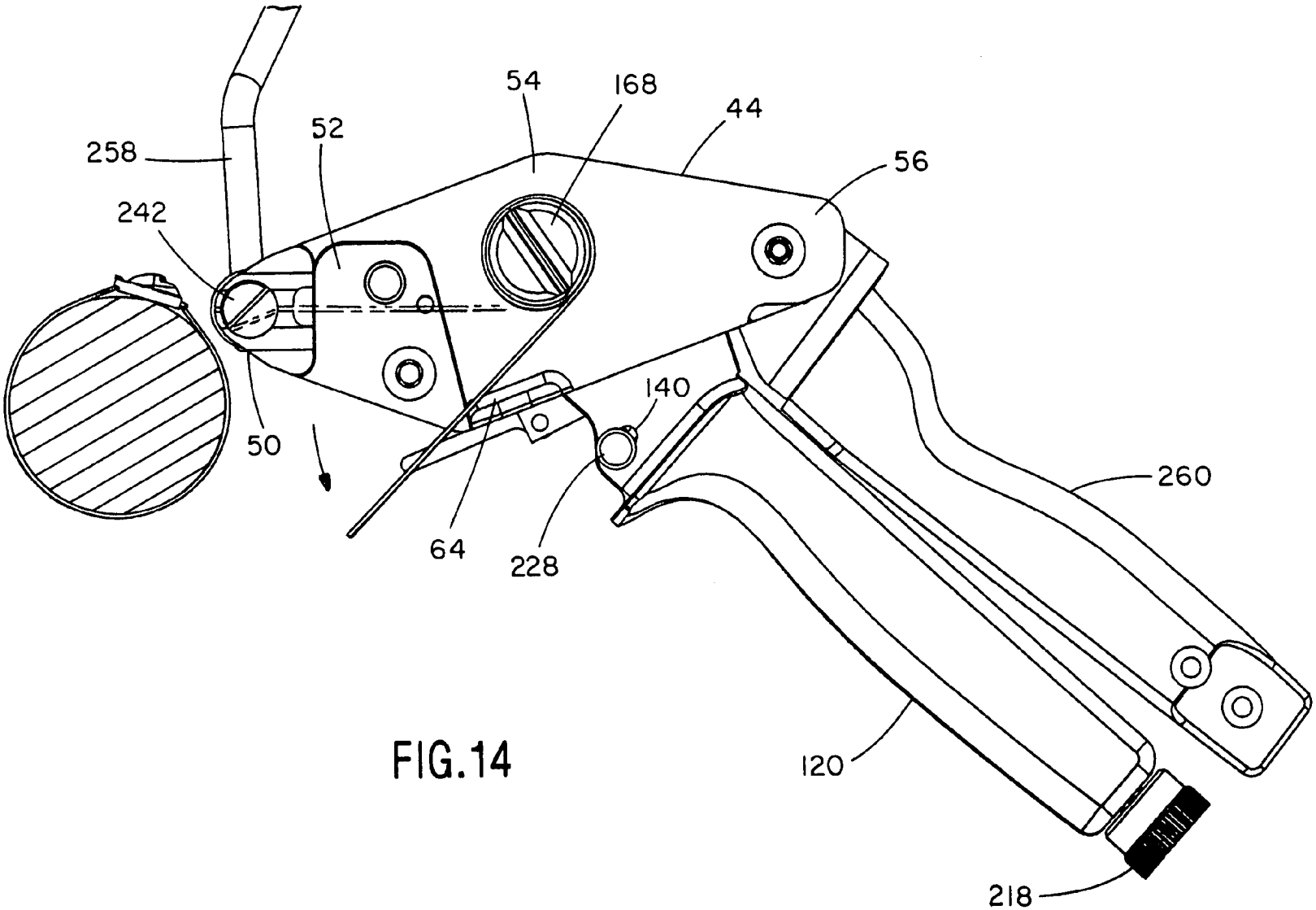
FIG. 14 is a left side elevational view of the installation tool of FIG. 1 with the metal tie being cut and the finger guard stopping the cut end of a metal tie as it uncoils.

As shown in FIGS. 12 and 13, once the tie reaches the desired tension, the detent roller 210 will detent out of the grooves 160 in the ratchet housing 146. The front handle 120 may continue to rotate towards the rear of the tool. As the front handle 120 continues to rotate, the detent roller 210 moves along the bottom edge 158 of the ratchet housing 146 pushing the plunger 202 downwards and compressing the spring 212 within the cavity 194 in the front handle 120. The ratchet housing 146 and the parts therein remain stationary and the tie ceases to be wound around the mandrel 168.

Once the pre-set tension is reached, the cutting mechanism may be engaged to cut the tie. As the cutter lever arm 258 is rotated, the cutting edge of the rotary cutter 242 within the cavity 60 of the housing 58 rotates to cut the tensioned tie disposed therein. After the tie is cut, the wound material often uncoils from the mandrel. The finger guard 64 extending from the outer side of the left member of the tool body stops the movement of the tie thereby protecting the user's hand and fingers from being snapped by the tie.

The pre-selected tension can be adjusted by rotating the knob 218 at the bottom of the front handle 120. As discussed above, the knob 218 is connected to the tension adjustment screw 216 and the tension adjustment block 214. As the knob 218 is turned, the spring 212 positioned within the front handle and disposed on the tension block is either compressed or expanded thereby adjusting the preset tension of the installation tool. The tool is designed such that the knob may be adjusted to set the tension from 50 lbs to a maximum of 750 lbs.

Alternatively, if desired, the lockout device 220 may be engaged to override the detent and allow the user to place tension on the tie without the influence of a preset detent. As illustrated in FIGS. 15–18 and as discussed above, the lockout device 220 includes an arcuate rear portion 222 and two openings 226 that house the lockout pins 228. The lockout pins 228 are slid towards the rear of the tool thereby pushing the lockout device 220 towards the plunger 202. As shown in FIG. 15, once the lockout pins 228 reach the rear end of the slots 140, the lockout device 220 engages the underside of the flange 206 at the top of the plunger 202. The lockout device 220 maintains the detent roller 210 in the grooves 160 in the ratchet housing 146 and prevents the plunger 202 from lowering and compressing the spring 212 in the front handle. As the user actuates the front handle 120, the ratchet wheel 162 and the mandrel 168 are rotated as described above. The front handle 120 may be rotated until the tie has reached the desired tension around the bundle. The cutter lever arm 258 may be rotated to cut the excess tie from the bundle.

Figure 18:
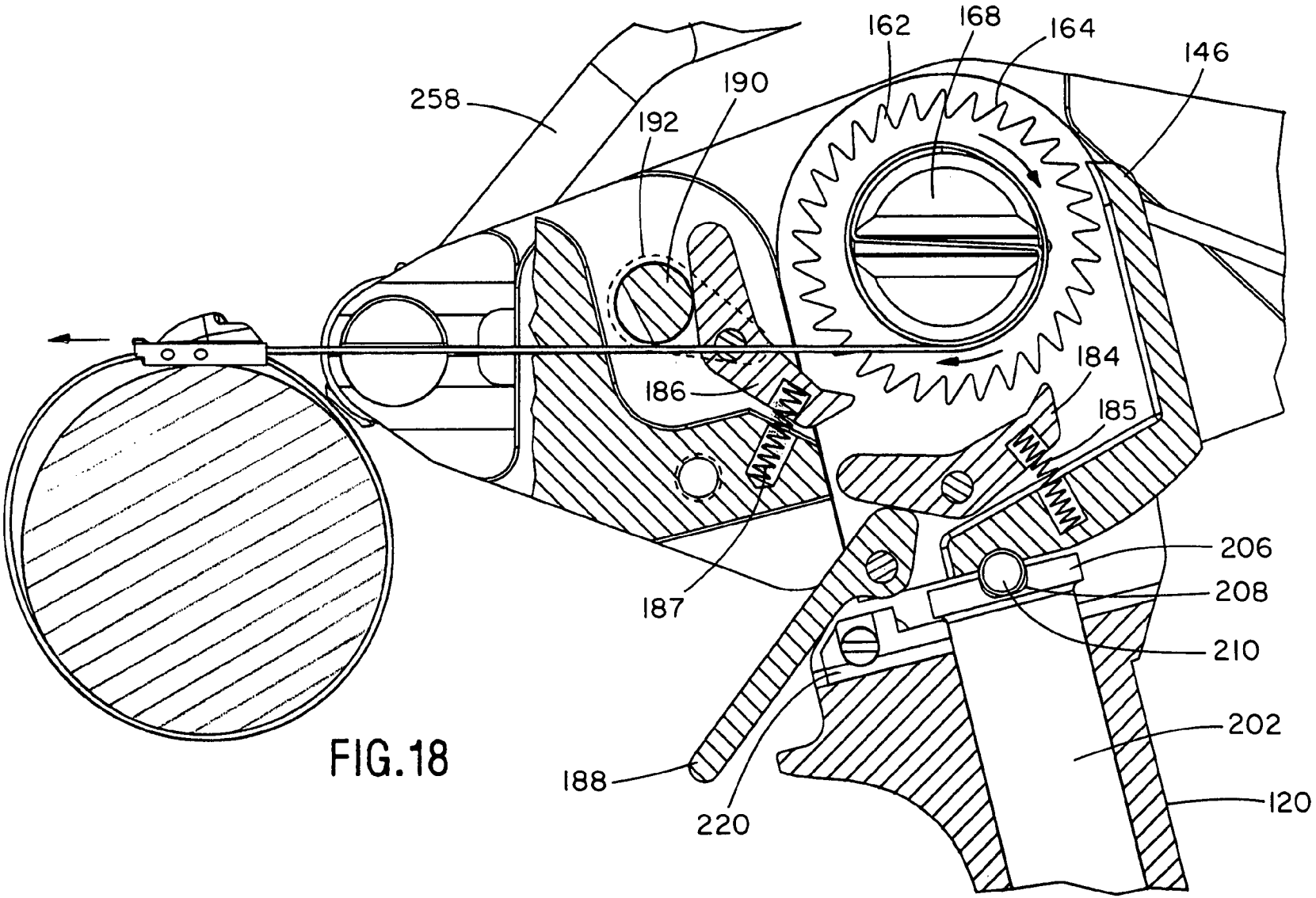
FIG. 18 is a cross sectional view of the installation tool of FIG. 10 with the pawls disengaged from the ratchet wheel.
Figure 19:
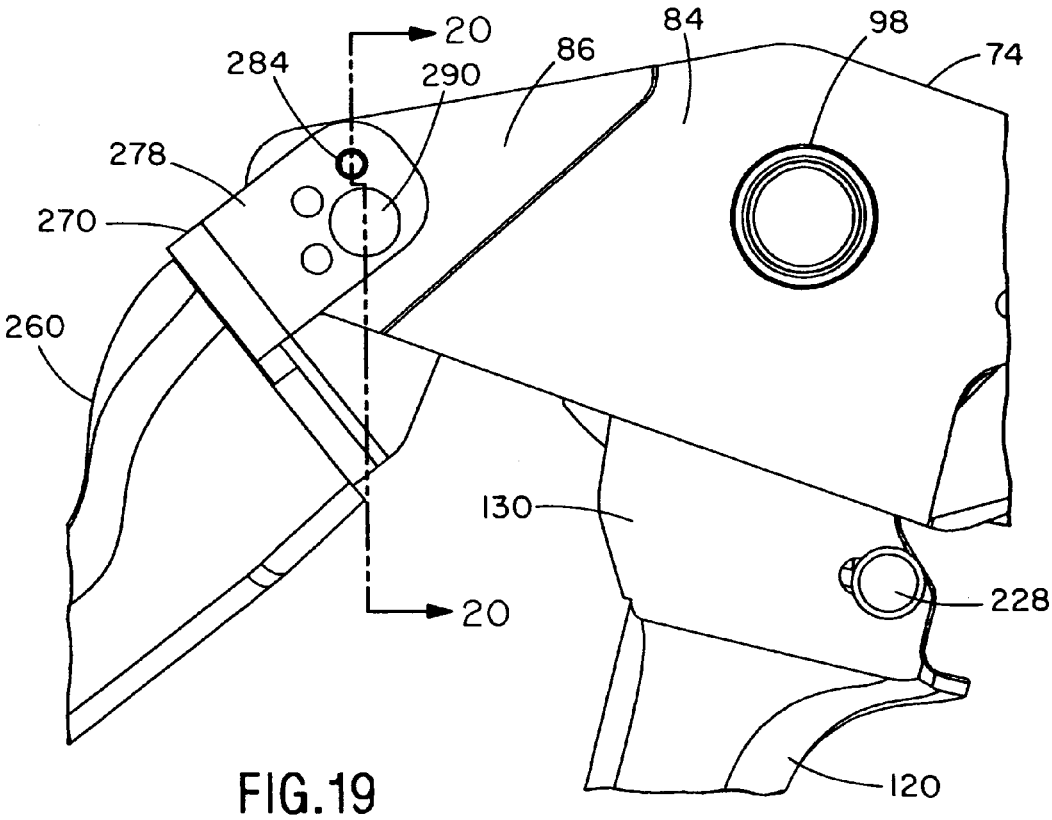
FIG. 19 is a side elevational view of the rear handle connected to the tool body of installation tool of FIG. 1.
Figure 20:
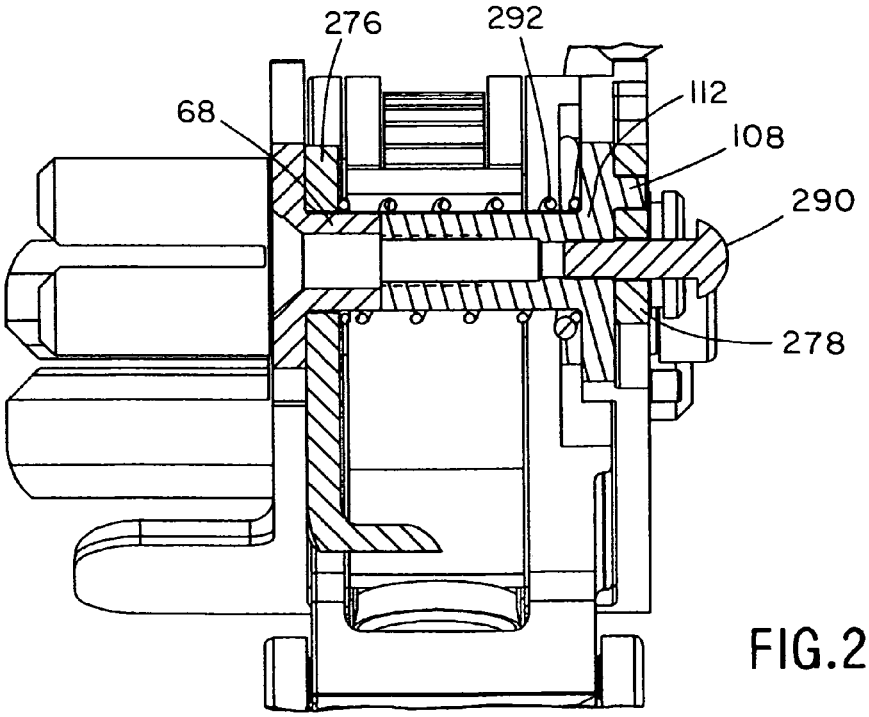
FIG. 20 is a cross sectional view of the rear handle connected to the tool body of the installation tool taken along line 20—20 of FIG. 19.

If tie cutoff is not desired, the pawl release levers may be activated to release tension from the metal tie. As shown in FIG. 18, the driving pawl release lever 188 is raised to disengage the driving pawl 184 and the holding pawl release lever 192 located on the outer side of the right member of the tool body is rotated thereby rotating the holding pawl release 190 to disengage the holding pawl 186. The tie can now be adjusted on the bundle or removed from the tool.

Figure 21:
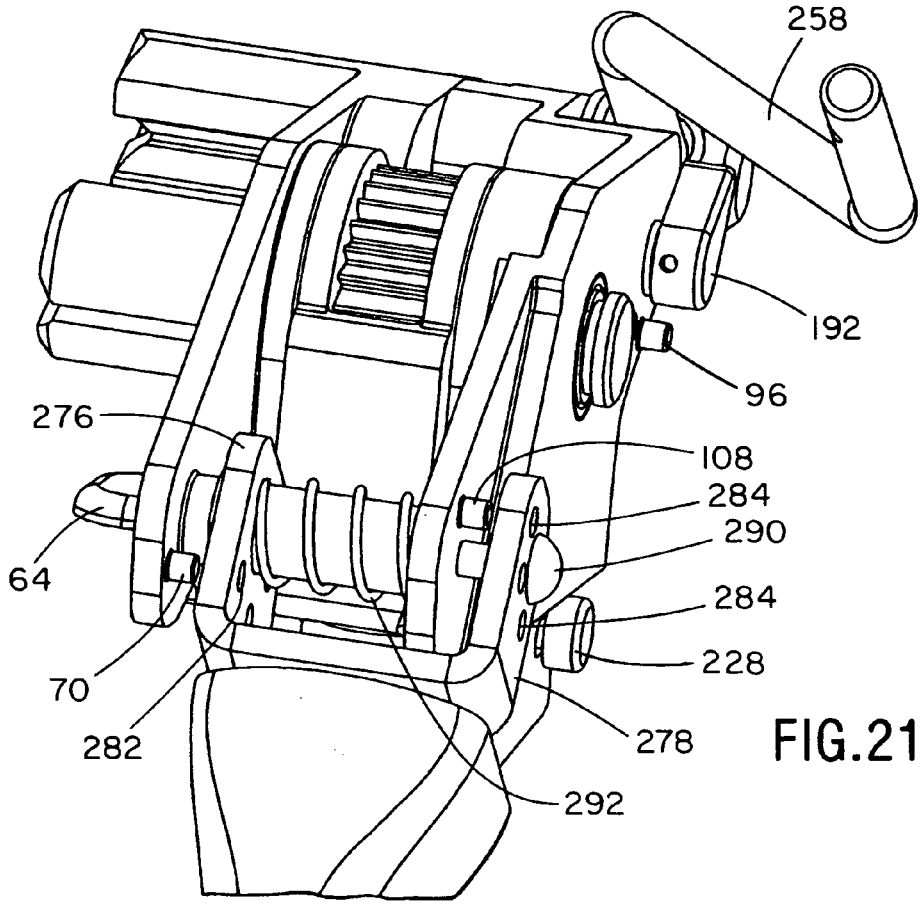
FIG. 21 is a rear perspective view of the rear handle connected to the tool body of the installation tool of FIG. 1.
Figure 22:
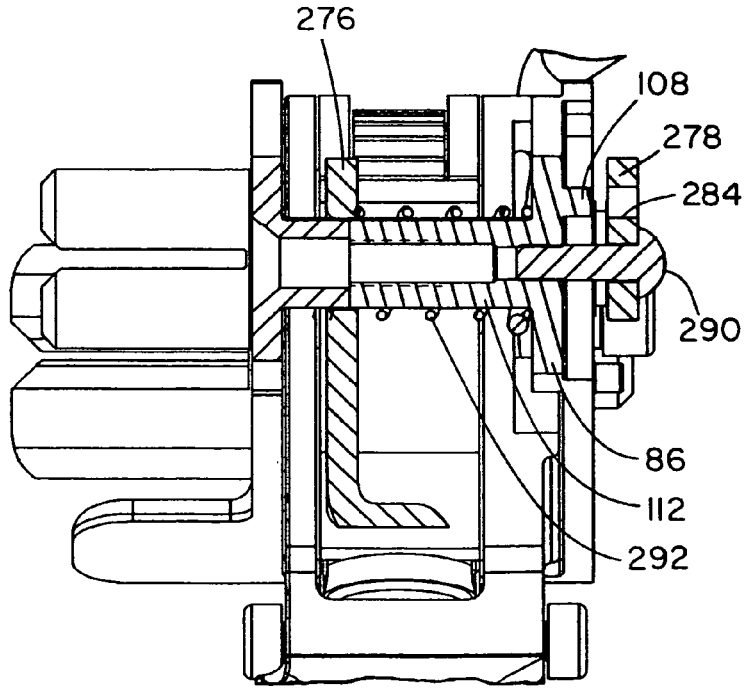
FIG. 22 is a cross sectional view of the rear handle connected to the tool body of the installation tool of FIG. 20 with the rear handle being released.

FIGS. 19–23 illustrate the adjustment mechanism that enables the rear handle 260 to be adjusted and secured in three positions. As illustrated in FIG. 21, the rear handle 260 is adjusted by first sliding the rear handle 260 toward the right member 74 of the tool body. As the rear handle 260 is slid, the stamping 270 of the rear handle moves along the shafts 68, 112 and compresses the spring 292 between the stamping and the tool body. The rear handle 260 is slid until the adjustment pins 70, 108 extending from the tool body are no longer engaged by the stamping. As a result, the rear handle 260 is free to rotate about the shafts 68, 112 to the desired position. Once the rear handle 260 has been rotated to the desired position and the adjustment pins 70, 108 are aligned with one of the small holes 282, 284 in each arm of the stamping, the rear handle 260 is released and slid towards the left member 44 of the tool body. Thus, the rear handle 260 is placed in a new position with the adjustment pins 70, 108 disposed in one set of holes 282, 284, respectively, in the stamping arms. As shown in phantom in FIG. 23, the rear handle may be adjusted to a high, medium or low position with respect to the tool body. While the figures illustrate the installation tool with a handle secured in a high, medium or low position, the tool may be designed such that the rear handle may be adjusted to other desired positions.

FIGS. 24–25 illustrate a second embodiment of the installation tool, indicated in general at 300, of the present invention. This second embodiment of the installation tool is used to install metal strapping around a bundle of objects. As discussed above, the tensioning mechanism, the lockout mechanism and the rear handle adjustment mechanism are the same as the tensioning mechanism, the lockout mechanism and the rear handle adjustment mechanism of the installation tool used to install metal ties. The cutting mechanism is also identical except for the position of the cutter lever arm. The cutter lever arm of the installation tool for the strapping extends from the rotary cutter downward towards the rear of the tool. The nose 302 of the installation tool for the strapping is elongated with a pointed end 304 or cut off tip for maintaining control of the metal strap when the strap is inserted in the nose. The rear handle of the installation tool also includes a buckle closer 310 that is disposed within the rear handle and extends from the bottom of the rear handle.

Once the metal strapping has been tensioned to a desired amount, the installation tool is tilted forward to bend the strapping at an angle that is sufficient to maintain the tension in the strapping. The cutter lever arm is then actuated to cut the strapping. The strap tip is bent down so that the tip is close to the buckle the strap was initially threaded through. The buckle closer 310 is used to bend a buckle retaining tab down and over the cut end of the strapping. This provides a finished and safe closure.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation.

The invention claimed is:

1. An installation tool comprising:

a tool body;

a front handle positioned within the tool body, the front handle having a tensioning mechanism disposed therein, wherein the tensioning mechanism includes a ratchet mechanism for tensioning a bundling member to a predetermined tensioned setting;

wherein the front handle includes an adapter having arms with a channel therebetween and the ratchet mechanism includes a ratchet housing positioned within the channel, the ratchet housing having sides with a groove formed in a bottom edge of each side; and a rear handle pivotally connected to the tool body.

2. The installation tool of claim 1, wherein the front handle houses a spring tensioned plunger adapted to engage the ratchet housing, wherein the plunger has a flange with a channel therein for housing a detent roller that engages the grooves in the bottom edge of the ratchet housing, whereby when the front handle is actuated the detent roller forces the ratchet housing to rotate until the bundling member reaches the predetermined tension and the detent roller detents out of the groove of the ratchet housing causing the ratchet housing to remain stationary.

3. The installation tool of claim 1, wherein the ratchet housing includes a ratchet wheel with a plurality of teeth, a driving pawl for advancing the ratchet wheel and a holding pawl for preventing the ratchet wheel from unwinding.

4. The installation tool of claim 3, further comprising a mandrel positioned through the adapter, the ratchet housing and the ratchet wheel, whereby when the ratchet wheel rotates, the mandrel rotates winding the bundling member positioned therein.

5. The installation tool of claim 1, further comprising a cutting mechanism pivotally connected to the tool body, wherein the cutting mechanism includes a rotary cutter for cutting the bundling member and a cutting lever arm for controlling the rotary cutter.

6. The installation tool of claim 5, wherein the tool body includes a nose having an outwardly extending housing with a cavity for housing a portion of the cutting mechanism.

7. The installation tool of claim 1, wherein the tool body includes an outwardly extending finger guard for controlling the cut bundling member as the bundling member uncoils.

8. An installation tool comprising:

a tool body;

a front handle positioned within the tool body, the front handle having a tensioning mechanism disposed therein for tensioning a bundling member to a predetermined tensioned setting;

a rear handle pivotally connected to the tool body, the rear handle including an adjustment mechanism for enabling the rear handle to be adjusted to various positions with respect to the tool body, wherein the tool body includes at least one shaft for supporting the rear handle and adjustment pins for locking the rear handle as the handle pivots; and wherein the rear handle includes a stamping with two upwardly extending arms and a channel therebetween, whereby when the rear handle is attached to the tool body, one of the arms is positioned between inner sides of the tool body and the opposite arm is positioned adjacent to an outer side of the tool body.

9. The installation tool of claim 8, wherein the upwardly extending arms include a plurality of opposing holes for receiving one of the adjustment pins.

10. The installation tool of claim 8, wherein the upwardly extending arms include a central hole for receiving the shaft extending inwardly from the tool body.

11. An installation tool comprising:

a tool body;

a front handle positioned within the tool body, the front handle having a tensioning mechanism disposed therein for tensioning a bundling member;

a lockout mechanism positioned within the front handle, the lockout mechanism overriding a predetermined tension setting of the tensioning mechanism to enable the bundling member to be tensioned to a desired amount; and a rear handle pivotally connected to the tool body.

12. The installation tool of claim 11, wherein the lockout mechanism includes an arcuate portion for engaging a flange of a spring tensioned plunger disposed in the front handle, whereby the lockout mechanism prevents the spring tensioned plunger from compressing in the front handle.

13. The installation tool of claim 12, wherein the lockout mechanism includes at least one side opening for receiving at least one pin disposed within a slot in the front handle, whereby the at least one pin slides within the at least one slot for enabling the lockout mechanism to slidingly engage the plunger disposed in the front handle.

14. An installation tool comprising:

a tool body;

a front handle positioned within the tool body, the front handle having a tensioning mechanism disposed therein for tensioning a bundling member to a predetermined tensioned setting;

a rear handle pivotally connected to the tool body, the rear handle including an adjustment mechanism for enabling the rear handle to be adjusted to various positions with respect to the tool body, wherein the tool body includes at least one shaft for supporting the rear handle and adjustment pins for locking the rear handle as the handle pivots; and a spring positioned on the at least one shaft of the tool body.

* * * * *